US011920599B2

(12) United States Patent
Ekambaram et al.

(10) Patent No.: US 11,920,599 B2
(45) Date of Patent: Mar. 5, 2024

(54) THRUST HANDLING FOR ELECTRIC SUBMERSIBLE PUMPS

(71) Applicant: Schlumberger Technology Corporation, Sugar Land, TX (US)

(72) Inventors: Raju Ekambaram, Singapore (SG); Teng Fei Wang, Singapore (SG); Pradeep Mahadevan, Singapore (SG); Kean Wee Cheah, Singapore (SG); David Milton Eslinger, Collinsville, OK (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 2 days.

(21) Appl. No.: 17/753,797

(22) PCT Filed: Sep. 18, 2020

(86) PCT No.: PCT/US2020/051408
§ 371 (c)(1),
(2) Date: Mar. 15, 2022

(87) PCT Pub. No.: WO2021/055689
PCT Pub. Date: Mar. 25, 2021

(65) Prior Publication Data

US 2022/0282732 A1 Sep. 8, 2022

Related U.S. Application Data

(60) Provisional application No. 62/912,397, filed on Oct. 8, 2019.

(30) Foreign Application Priority Data

Sep. 19, 2019 (SG) ..... 10201908737X

(51) Int. Cl.
*F04D 13/10* (2006.01)
*F04D 25/06* (2006.01)
(Continued)

(52) U.S. Cl.
CPC ..... *F04D 13/10* (2013.01); *F04D 25/062* (2013.01); *F04D 29/041* (2013.01);
(Continued)

(58) Field of Classification Search
CPC .. F04D 13/10; F04D 29/0473; F04D 29/0413; F04D 29/061; F04D 29/448; F04D 1/063
See application file for complete search history.

(56) References Cited

U.S. PATENT DOCUMENTS 3,597,027 A * 8/1971 Herndon ..... F16C 33/08 384/305
4,420,160 A * 12/1983 Laham ..... F16J 15/38 277/306

(Continued)

FOREIGN PATENT DOCUMENTS

WO 2016032439 A1 3/2016

OTHER PUBLICATIONS

International Search Report and Written Opinion issued in the PCT Application PCT/US2020/051408, dated Dec. 23, 2020 (10 pages).

*Primary Examiner* — Dominick L Plakkoottam
(74) *Attorney, Agent, or Firm* — Philippe Laguerre

(57) ABSTRACT

An electric submersible pump includes a plurality of centrifugal pump stages, each stage including a rotating impeller and a stationary diffuser mounted on a shaft coupled to a motor. An upthrust washer can be disposed axially between an impeller and its associated diffuser at or near a tip of the impeller, and the gap between the impeller tip and diffuser can define the end play or axial clearance for the pump. If the upthrust washer wears away, upthrust rubbing occurs at
(Continued)

the impeller tip instead of proximate the pump shaft to advantageously help protect the shaft from damage or failure related to heat. In some ESPs, an upthrust bearing assembly can be located at the pump head. A downthrust washer can be disposed in an upstream facing groove of the impeller. The downthrust washer can have a thickness greater than 0.10 in.

17 Claims, 20 Drawing Sheets

(51) Int. Cl.
*F04D 29/041* (2006.01)
*F04D 29/047* (2006.01)
*F04D 29/06* (2006.01)
*F04D 29/44* (2006.01)

(52) U.S. Cl.
CPC ..... *F04D 29/0473* (2013.01); *F04D 29/061* (2013.01); *F04D 29/448* (2013.01); *F04D 29/0413* (2013.01)

(56) References Cited

U.S. PATENT DOCUMENTS 4,662,827 A * 5/1987 Wiernicki ..... F04C 11/008 417/366
4,872,808 A * 10/1989 Wilson ..... F04D 29/0413 415/199.2
6,106,224 A * 8/2000 Sheth ..... F04D 29/0465 415/174.3
2005/0200216 A1* 9/2005 Brown ..... F04D 29/668 310/90
2006/0171616 A1* 8/2006 Richie ..... F16C 17/065 384/121
2006/0204359 A1* 9/2006 Semple ..... F04D 29/047 415/170.1
2009/0285678 A1* 11/2009 Brunner ..... F04D 29/44 415/199.3
2011/0058928 A1* 3/2011 Sheth ..... F01D 3/02 415/199.1
2012/0020777 A1* 1/2012 Eslinger ..... F04D 1/063 416/174
2013/0017075 A1* 1/2013 Orban ..... F04D 29/026 415/199.2
2013/0209225 A1* 8/2013 Eslinger ..... F04D 1/06 29/888.024
2015/0204336 A1* 7/2015 McManus ..... F04D 29/0413 415/203
2015/0226219 A1* 8/2015 Johnson ..... F04D 1/06 417/423.3
2016/0115998 A1* 4/2016 Jayaram ..... F04D 29/448 384/296
2017/0167498 A1* 6/2017 Chang ..... F04D 29/0416
2017/0211582 A1* 7/2017 Patel ..... F04D 13/10
2017/0350399 A1* 12/2017 Eslinger ..... F04D 29/426
2018/0017066 A1* 1/2018 Nowitzki ..... F04D 29/04
2018/0291907 A1* 10/2018 Ye ..... F04D 29/026

* cited by examiner

THRUST HANDLING FOR ELECTRIC SUBMERSIBLE PUMPS

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application claims priority benefit of Singapore Application No. SG 10201908737X, filed Sep. 19, 2019, and Provisional U.S. Patent Application No. 62/912,397, filed Oct. 8, 2019, the entirety of each of which is incorporated by reference herein and should be considered part of this specification.

BACKGROUND

Field

The present disclosure generally relates to systems and methods for artificial lift in oil and gas wells, and more particularly to thrust handling systems and methods for use in electric submersible pumps.

Description of the Related Art

Various types of artificial lift equipment and methods are available, for example, electric submersible pumps (ESPs). An ESP includes multiple centrifugal pump stages mounted in series, each stage including a rotating impeller and a stationary diffuser mounted on a shaft, which is coupled to a motor. In use, the motor rotates the shaft, which in turn rotates the impellers within the diffusers. Well fluid flows into the lowest stage and passes through the first impeller, which centrifuges the fluid radially outward such that the fluid gains energy in the form of velocity. Upon exiting the impeller, the fluid flows into the associated diffuser, where fluid velocity is converted to pressure. As the fluid moves through the pump stages, the fluid incrementally gains pressure until the fluid has sufficient energy to travel to the well surface. One or more thrust assemblies, for example, upthrust assemblies and/or downthrust assemblies, can be disposed axially between a portion of the impeller and a portion of the associated diffuser, and/or operatively connect the impeller and diffuser. The thrust assemblies can help absorb or accommodate thrust in use.

SUMMARY

In some configurations, an electric submersible pump (ESP) includes a plurality of stages, at least one stage comprising a rotating impeller rotationally fixed to a shaft of the ESP, a stationary diffuser rotationally fixed to a housing of the ESP, and an upthrust washer disposed axially between a portion of the impeller and a portion of the diffuser. The upthrust washer is disposed radially outside of the balance ring.

The ESP can include a second upthrust washer disposed adjacent a leading edge shoulder of the diffuser. The second upthrust washer can include one or more lubrication grooves.

A balance ring of the impeller can include one or more lubrication grooves. The diffuser can include one or more lubrication grooves. A central hub of the diffuser can include one or more lubrication grooves in a leading or upstream edge of the central hub. A ring surrounding a central hub of the diffuser can include one or more lubrication grooves in a leading edge shoulder of the ring.

The upthrust washer can be made of or include phenolic material, tungsten carbide, silicon carbide, and/or any other suitable material, such as a wear resistant material and/or coating.

An axial gap between the portion of the impeller and the portion of the diffuser can be smaller than an axial gap between a downstream edge of a balance ring of the impeller and the diffuser. An axial gap between the portion of the impeller and the portion of the diffuser can be smaller than an axial gap between the diffuser and an upwardly facing surface of the impeller disposed radially between a central hub of the impeller and a balance ring of the impeller. In some configurations, the ESP includes a bearing assembly disposed radially between the shaft and the diffuser. An axial gap between the portion of the impeller and the portion of the diffuser can be smaller than an axial gap between the bearing assembly and an upwardly facing surface of the impeller disposed radially between a central hub of the impeller and a balance ring of the impeller.

In some configurations, an electric submersible pump (ESP) includes a plurality of centrifugal stages, each stage comprising a rotating impeller and a stationary diffuser disposed about a rotating shaft, and an upthrust bearing assembly. The upthrust bearing assembly includes a bearing sleeve disposed about the shaft and rotationally keyed to the shaft, a stationary bushing disposed about the bearing sleeve, the bushing having a generally T-shaped longitudinal cross-section shape and a bore extending longitudinally therethrough, the bushing having a base portion and a thrust pad at an upstream end of the base portion, and an upthrust bearing runner disposed about the shaft upstream of the bushing, the upthrust bearing runner configured to move toward an upthrust surface of the thrust pad of the bushing when the ESP operates in an upthrust condition.

The upthrust bearing can be disposed proximate a top or downstream end of the plurality of centrifugal stages. The upthrust bearing can be disposed in a pump head section. The upthrust surface can include one or more grooves configured to allow fluid flow. The ESP can include a compliance between the upthrust bearing and the head section to prevent or inhibit impact loading on the bearing.

The bushing can include an anti-rotation feature configured to rotationally fix the bushing. The anti-rotation feature can include notches in a downstream end of the base portion and/or a downstream surface of the thrust pad. The anti-rotation feature can include a groove in an outer surface of the base portion extending axially along at least a portion of a length of the base portion.

In some configurations, an electric submersible pump (ESP) includes a plurality of centrifugal stages, each stage comprising a rotating impeller and a stationary diffuser disposed about a rotating shaft; and at least one impeller comprising a downthrust washer disposed in an upstream facing groove of the impeller, the downthrust washer having an axial thickness such that the downthrust washer extends upstream and out of the groove. The downthrust washer can have a thickness greater than 0.10 in.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Figure 1:
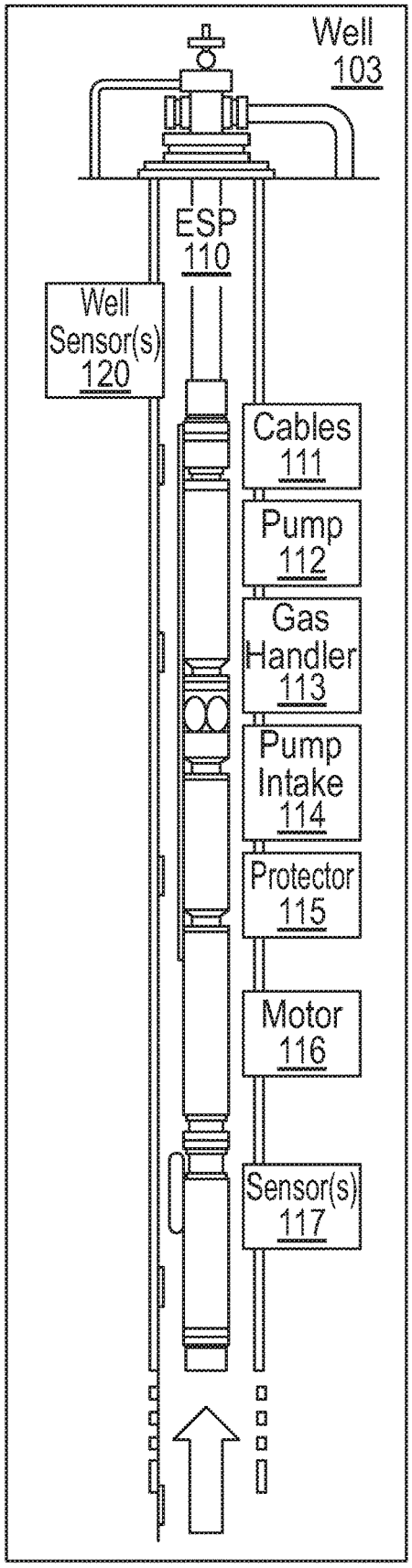
FIG. 1 shows a schematic of an electric submersible pump (ESP) system.

Various types of artificial lift equipment and methods are available, for example, electric submersible pumps (ESP). As shown in the example embodiment of FIG. 1, an ESP 110 typically includes a motor 116, a protector 115, a pump 112, a pump intake 114, and one or more cables 111, which can include an electric power cable. The motor 116 can be powered and controlled by a surface power supply and controller, respectively, via the cables 111. In some configurations, the ESP 110 also includes gas handling features 113 and/or one or more sensors 117 (e.g., for temperature, pressure, current leakage, vibration, etc.). As shown, the well may include one or more well sensors 120.

Figure 2A:
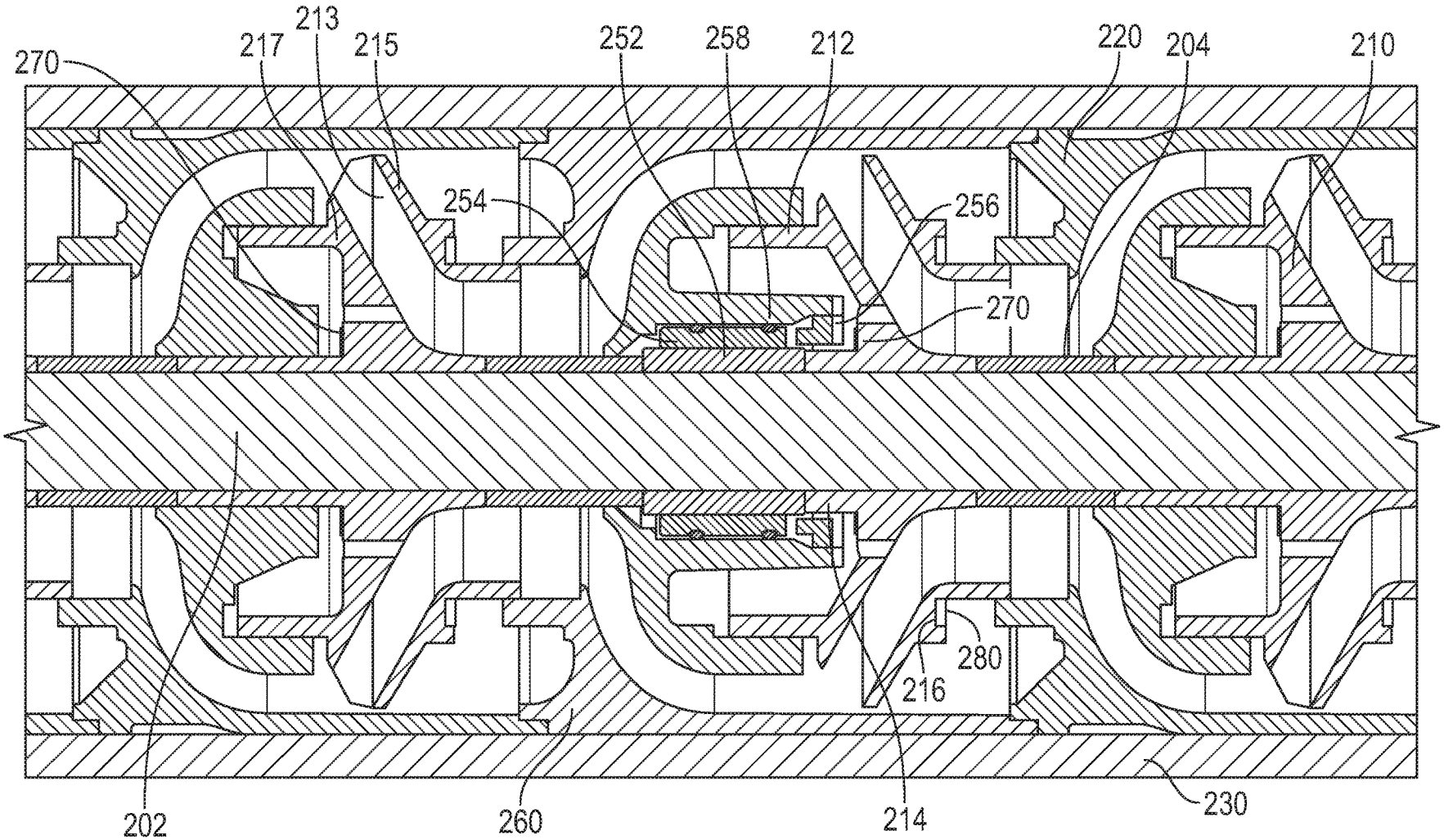
FIG. 2A shows a cross-section of a portion of a pump section of the ESP system of FIG. 1.
Figure 2B:
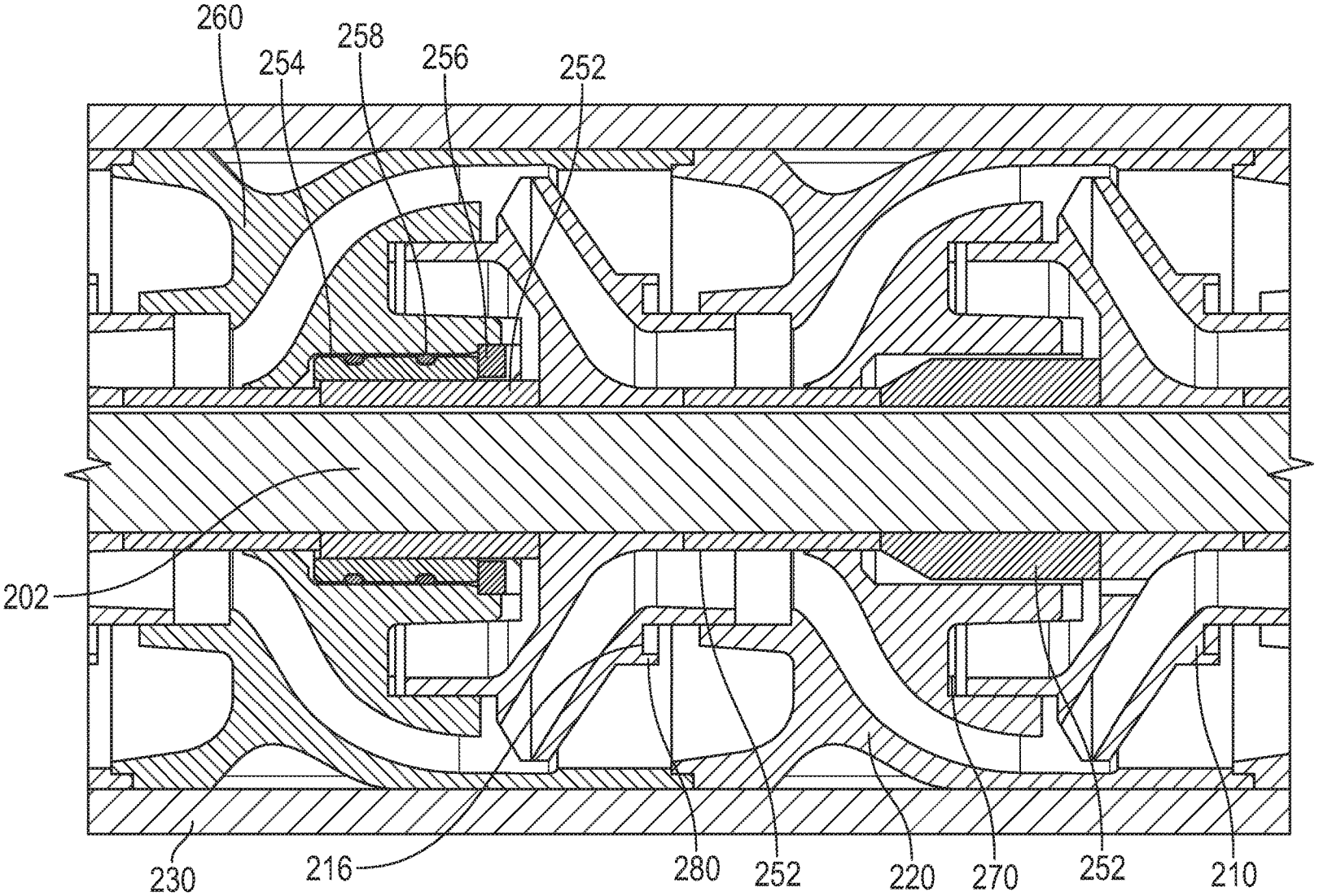
FIG. 2B shows a cross-section of a portion of a pump section of another embodiment of an ESP pump.

The pump 112 includes multiple centrifugal pump stages mounted in series within a housing 230, as shown in FIG. 2A. FIG. 2B illustrates another example embodiment of a pump section including multiple pump stages mounted in series within a housing 230. Each stage includes a rotating impeller 210 and a stationary diffuser 220. One or more spacers 204 can be disposed axially between sequential impellers 210. A shaft 202 extends through the pump 112 (e.g., through central hubs or bores or the impellers 210 and diffusers 220) and is coupled to the motor 116. The impellers 210 are rotationally coupled, e.g., keyed, to the shaft 202. The diffusers 220 are coupled, e.g., rotationally fixed, to the housing 230. In use, the motor 116 rotates the shaft 202, which in turn rotates the impellers 210 relative to and within the stationary diffusers 220.

In use, well fluid flows into the first (lowest) stage of the pump 112 and passes through an impeller 210, which centrifuges the fluid radially outward such that the fluid gains energy in the form of velocity. Upon exiting the impeller 210, the fluid makes a sharp turn to enter a diffuser 220, where the fluid's velocity is converted to pressure. The fluid then enters the next impeller 210 and diffuser 220 stage to repeat the process. As the fluid passes through the pump stages, the fluid incrementally gains pressure until the fluid has sufficient energy to travel to the well surface.

As shown in FIGS. 2A-2B, a bearing assembly can be disposed between, e.g., at least partially radially between, the shaft 202 and a diffuser 220 and/or between, e.g., at least partially axially between, an impeller 210 and its associated diffuser 220. A portion of the diffuser 220 can act as a bearing housing 260. In the illustrated embodiment, the bearing assembly includes a bearing sleeve 252 disposed about the shaft 202 and a bushing 254 disposed about the bearing sleeve 252 and radially between the bearing sleeve 252 and a portion of the diffuser 220. One or more o-rings 258 can be disposed about the bushing 254, for example, radially between the bushing 254 and the diffuser 220 or bearing housing 260.

The illustrated bearing assembly also includes an anti-rotation upthrust ring 256 disposed about the bearing sleeve 252. As shown, the anti-rotation upthrust ring 256 can be disposed adjacent an upstream end of the bushing 254. The bearing sleeve 252 is keyed or rotationally coupled to the shaft 202 such that the bearing sleeve 252 rotates with the shaft in use 202. The anti-rotation upthrust ring 256 prevents or inhibits the bushing 254 from rotating such that the bushing 254 is stationary or rotationally fixed relative to the diffuser 220. The anti-rotation upthrust ring 256 can also help prevent or inhibit axial movement of the bushing 254 and/or the bushing 254 from dropping out of place from the bearing housing 260. In use, the bearing assembly can help absorb thrust and/or accommodate the rotation of the shaft relative to the diffuser.

The pump 112 can also include one or more thrust assemblies, for example, upthrust assemblies and/or downthrust assemblies, disposed axially between portions of and/or operatively connecting an impeller 210 and its associated diffuser 220. A thrust assembly can include a thrust washer and a thrust pad, which may be a portion of the impeller 210 or diffuser 220. In the configuration of FIG. 2A, an upthrust washer 270 is disposed on, adjacent, or proximate an upper surface, or upwardly facing surface, of the impeller 210. In the illustrated configuration, the upthrust washer 270 is positioned adjacent a central hub 214 or portion of the impeller 210 having a bore through which the shaft 202 extends and radially between the hub 214 and a balance ring 212 of the impeller 210. In use, the illustrated upthrust washer 270 contacts the anti-rotation upthrust ring 256 when the pump 112 is operating in an upthrust condition, for example, during HPTS testing at a wide open condition, improper or over shimming at a well site, and/or operating beyond maximum operating range in the field. In some configurations, the pump 112 also includes one or more downthrust assemblies. In the configurations of FIGS. 2A and 2B, a downthrust washer 280 is disposed on or adjacent a lower, or downwardly facing surface, of the impeller 210, and is disposed axially between a portion of the impeller 210 and a portion of the associated diffuser 220.

Figure 3:
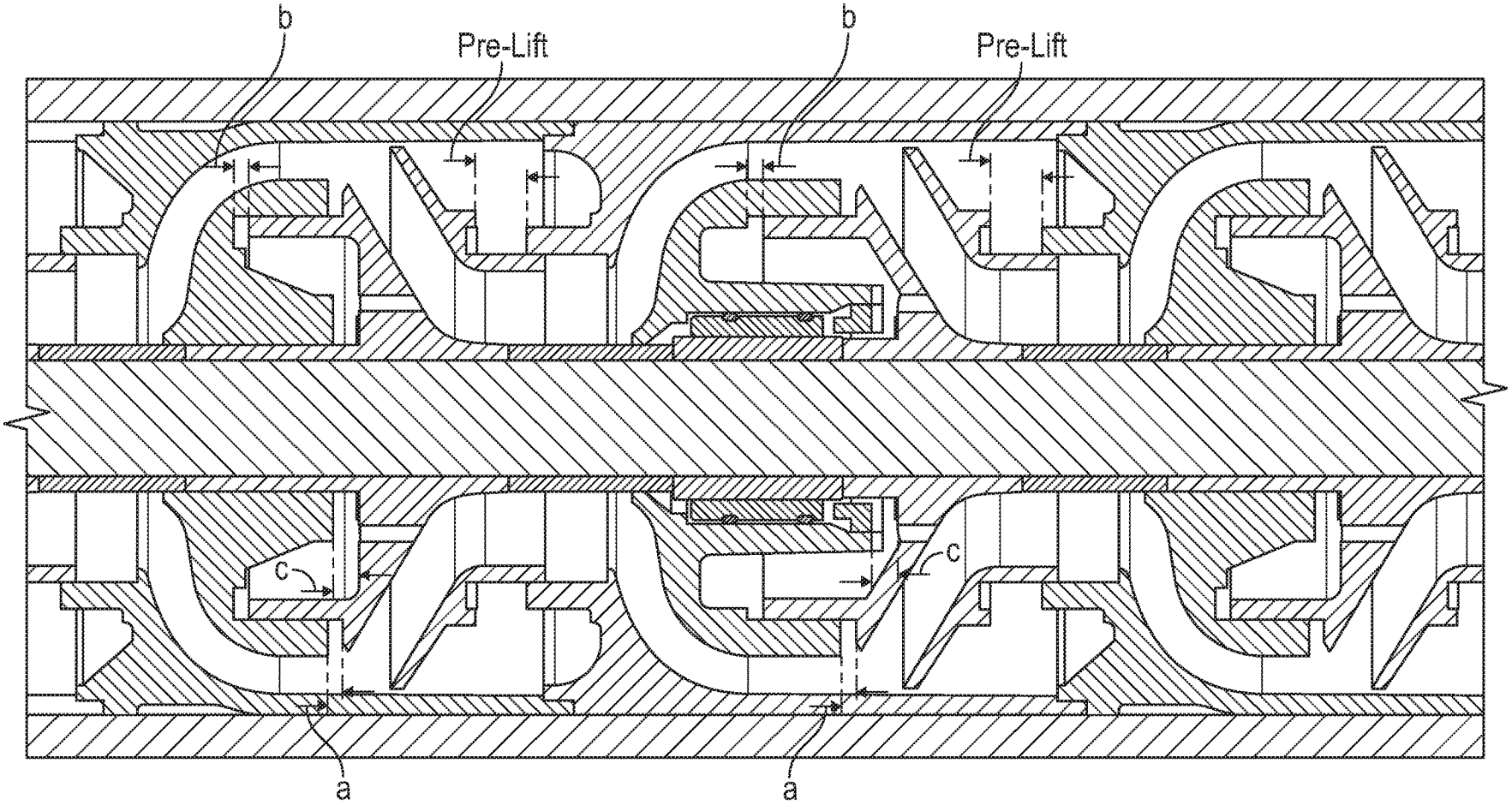
FIG. 3 shows the cross-section of FIG. 2A showing gaps between various components.

Typically, the end play of the pump 112 is defined as the minimum free axial movement, or axial clearance, between the impeller 210 and associated diffuser 220. FIG. 3 illustrates the upthrust gap between the impeller 210 and diffuser 220 at various locations in the pump 112. A first gap (a) exists between a tip of the impeller 210 and the diffuser 220 or bearing housing 260. A second gap (b) exists between a tip, end, or free edge of the balance ring 212 of the impeller 210 and the diffuser 220. A third gap (c) exists between the upper surface adjacent the hub 214 of the impeller 210 and an upthrust pad of the diffuser 220. The end play is the amount of pre-lift plus the smallest of the three gaps.

In the configuration of FIG. 2A, the upthrust washer 270 is located in gap (c). In some cases, thrust washers, such as upthrust washer 270 and/or downthrust washer 280, become worn and/or fail during use. Upthrust wear and/or damaged or missing upthrust washers 270 can occur sooner when operating in unfavorable upthrust conditions, like HPTS testing in wide open conditions, improper or over shimming, operating at high flow outside ROR at a well site. If the upthrust washer 270 is damaged or wears off, for example, in a sandy or unconventional well, there could be metal-to-metal upthrust wear (for example, between the impeller 210 and upthrust ring 256 and/or upthrust pad of the diffuser 220), which can significantly increase the horsepower of the ESP. In some cases, extreme heat could be generated, which could eventually lead to shaft 202 damage, due to, for example, lack of lubrication (due to vaporization of liquid in the area due to the heat), heat, and/or shaft 202 seizure (for example, due to expansion of metal components). FIG. 2B illustrates an alternative configuration in which the upthrust washer 270 is located in gap (b).

Figure 4:
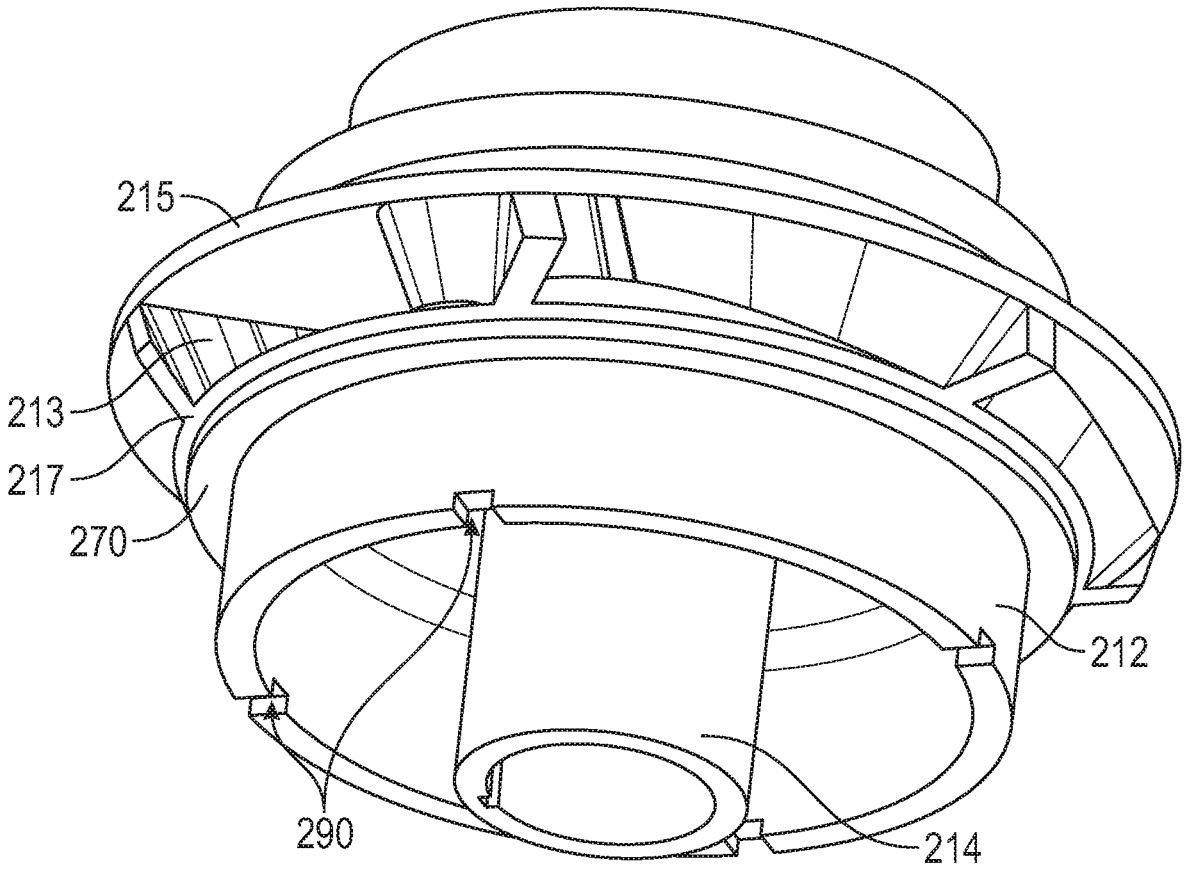
FIG. 4 shows a perspective view of an example embodiment of an impeller including an upthrust washer.
Figure 6:
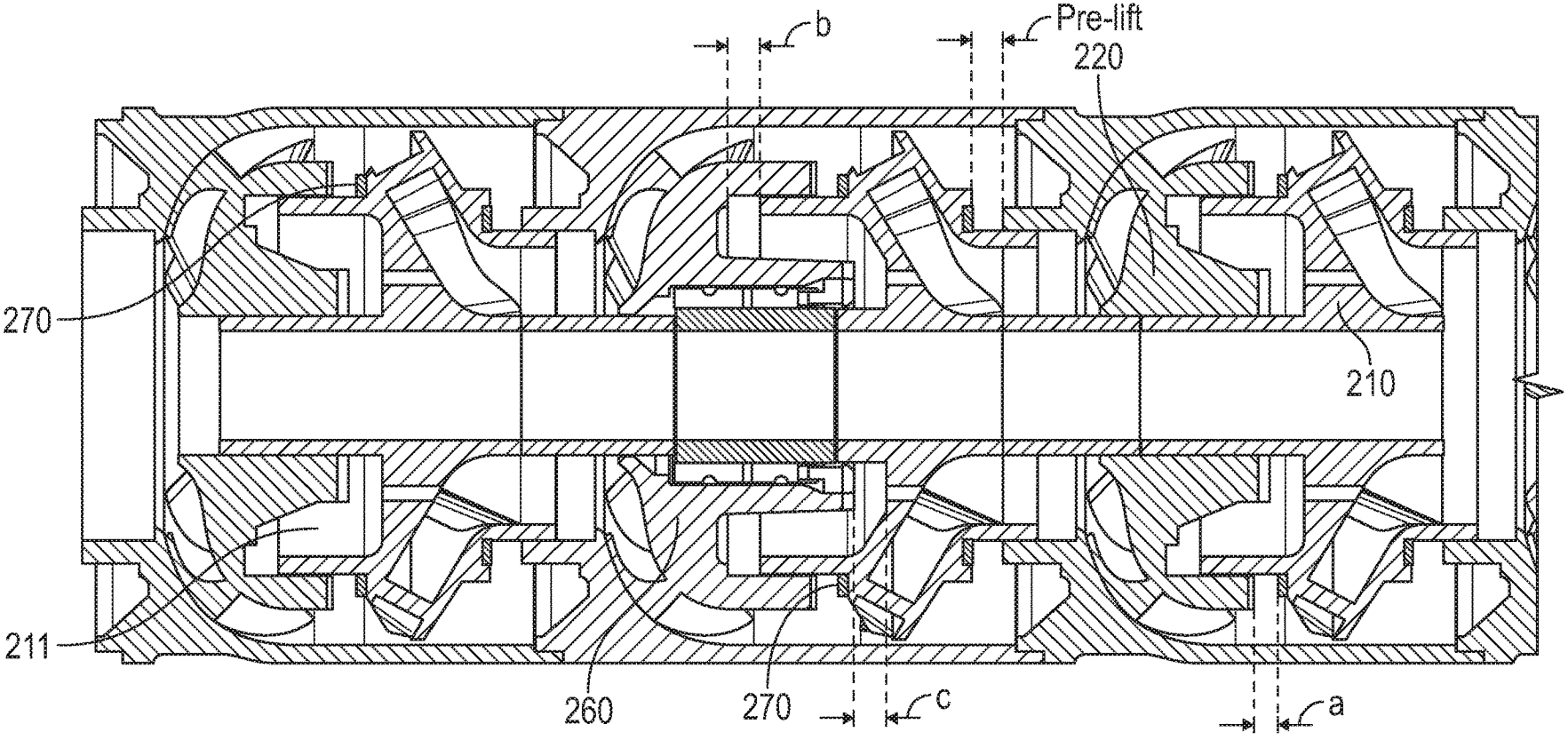
FIG. 6 shows a cross-section of a portion of an example embodiment of a pump section of an ESP including the impeller of FIG. 4, the bearing housing of FIG. 5A, and the diffuser of FIG. 5B.

In some configurations according to the present disclosure, the upthrust washer 270 is instead located in gap (a), for example as shown in FIGS. 4 and 6. As shown, the upthrust washer 270 is located at, adjacent, or proximate the impeller 210 tip and adjacent the balance ring 212. In other words, the upthrust washer 270 is located at, adjacent, or proximate the hub 214 side (radial side) of the impeller 210 tip. As shown in FIGS. 2A and 4, blades 213 of the impeller 210 can extend between a lower plate or disc 215 and an upper plate or disc 217. As shown in FIG. 4, the upthrust washer 270 can be disposed on or adjacent an upward or downstream facing surface of the upper plate 217. In other words, the upthrust washer 270 can be disposed at a base of the balance ring 212. As shown, the upthrust washer 270 can be disposed radially outward of and/or adjacent a radially outer surface of the balance ring 212. Locating the upthrust washer 270 at or on the impeller 210 tip separates the washer 270 away from the shaft 202, which can help prevent, inhibit, or reduce the likelihood of shaft 202 damage due to heat generated by upthrust rubbing, should the washer 270 become damaged or wear away. The pump 112 can therefore continue to operate in upthrust conditions with a lower likelihood of a broken shaft 202. The upthrust washer 270 can be made of or include phenolic material, tungsten carbide, silicon carbide, and/or any other suitable material (s), for example, any wear resistant material and/or coating.

Figure 5B:
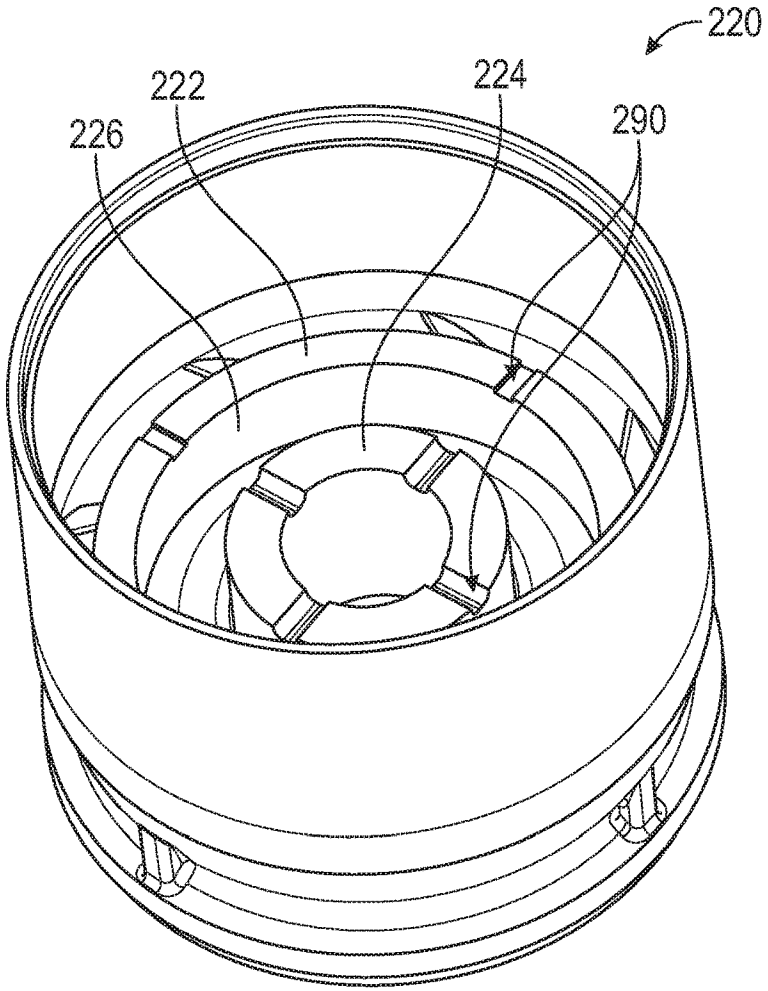
FIG. 5B shows a perspective view of an example embodiment of a diffuser including lubrication grooves.
Figure 5A:
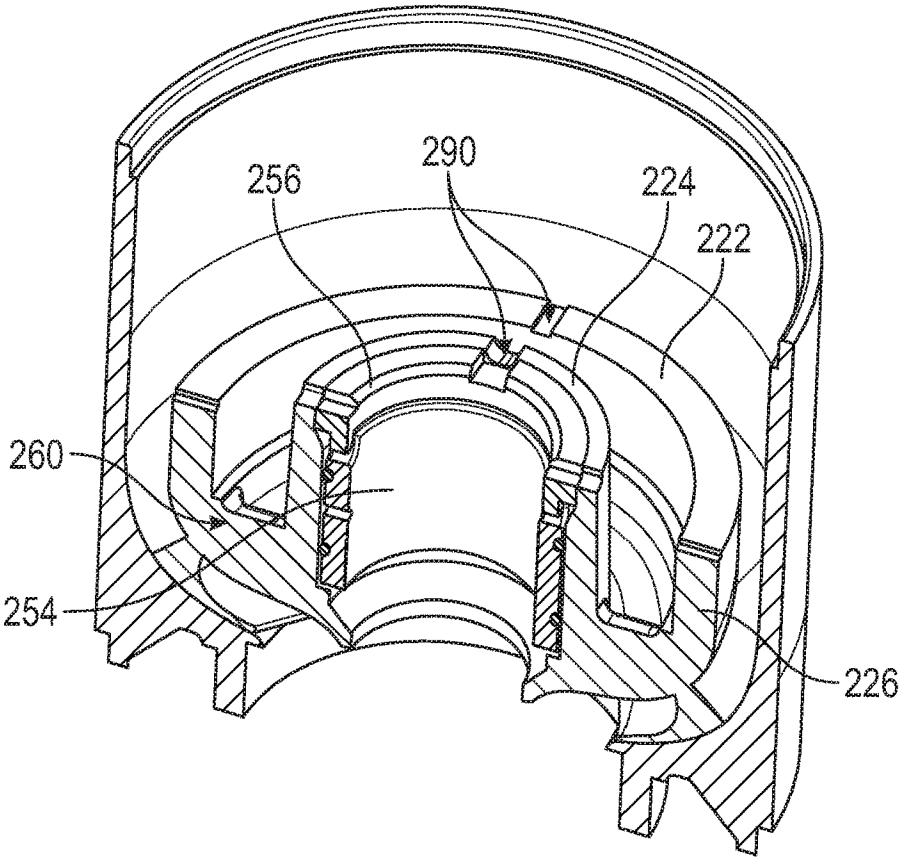
FIG. 5A shows a cross-section of an example embodiment of a bearing housing including lubrication grooves.

In some configurations, the balance ring tip 212 includes lubrication grooves 290. The lubrication grooves 290 can be machined into or cast in the balance ring 212 tip, edge, or end surface. As shown in FIG. 5B, the diffuser 220, or diffuser in the form of a bearing housing 260 as shown in FIG. 5A, can include lubrication grooves 290, for example, in a leading edge shoulder 222 of diffuser ring 226 (i.e., recessed or cut into the ring 226 from the leading edge shoulder 222) and/or an edge or end surface of the hub 224. The lubrication grooves 290 can be machined into or cast in the diffuser 220 or bearing housing 260. The lubrication grooves 290 (of the impeller 210 and/or diffuser 220) can have various shapes or profiles, for example, squared, rounded, semi-rounded, V-shaped, W-shaped, and/or spiraled in a clockwise or counter-clockwise direction.

In the configuration of FIG. 3, gaps (a), (b), and (c), are the same, or have equal or about equal axial lengths. In contrast, in a configuration in which the upthrust washer 270 is disposed in gap (a), for example as shown in FIG. 6, gap (a) is smaller than gaps (b) and (c). In some such configurations, gap (b) is smaller than gap (c). In use, when the pump 112 is operating in an upthrust condition, gap (a) closes first, before gap (b) and gap (c). As gap (a) is closer to the impeller 210 fluid exit (for example, compared to gap (c)), the fluid flow in the vicinity of gap (a) has a higher velocity, thereby allowing for faster heat convection and faster cooling of components in that vicinity in the event of upthrust rubbing. Lubrication grooves 290 on the impeller 210 and/or diffuser 220 allow fluid to still flow into the balance chamber 211 so that the bearing assembly does not become lubrication starved. The improved cooling and/or lubrication can help reduce the risk of shaft 202 damage or failure.

Figure 7B:
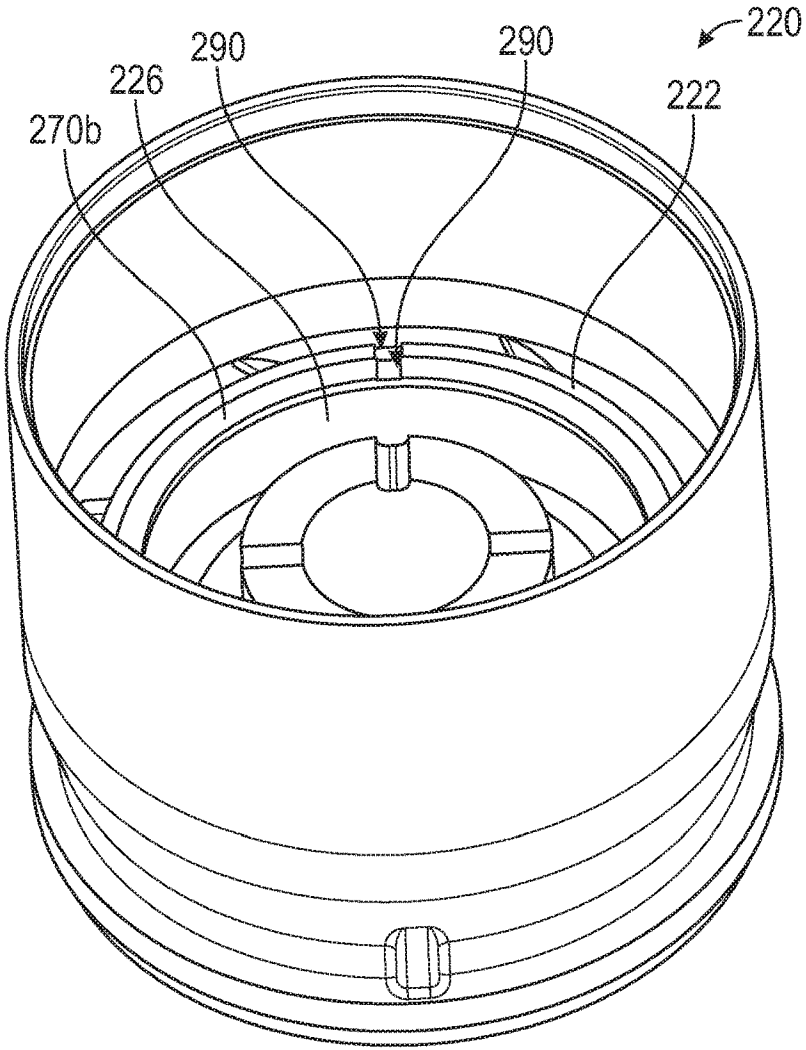
FIG. 7B shows a perspective of an example embodiment of a diffuser including an upthrust washer and lubrication grooves.
Figure 7A:
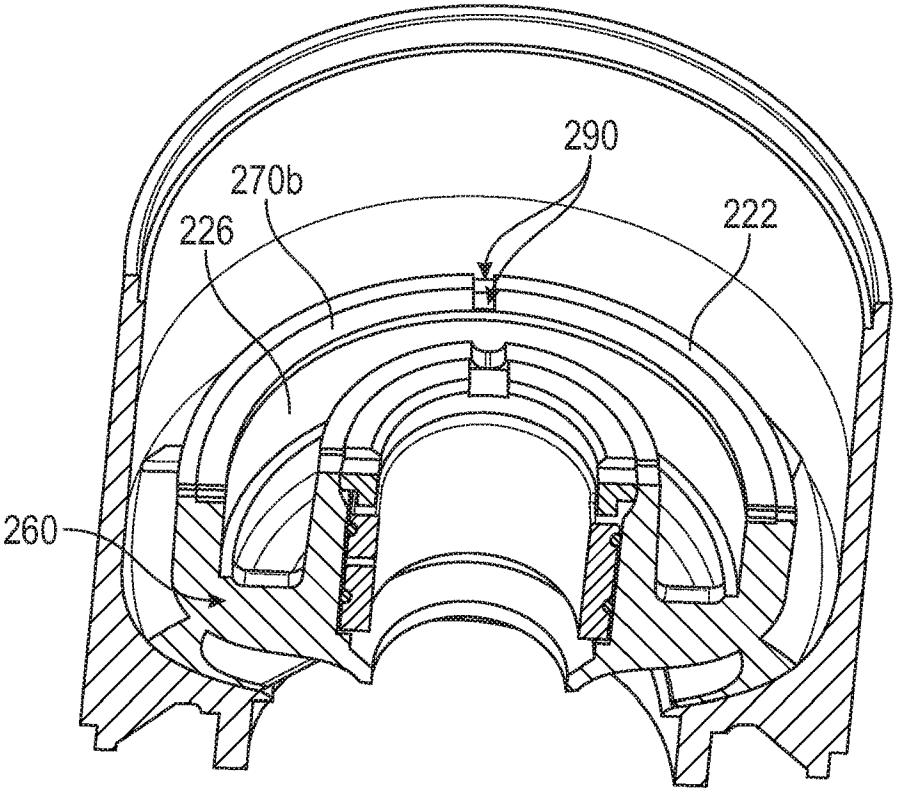
FIG. 7A shows a cross-section of an example embodiment of a bearing housing including an upthrust washer and lubrication grooves.
Figure 8:
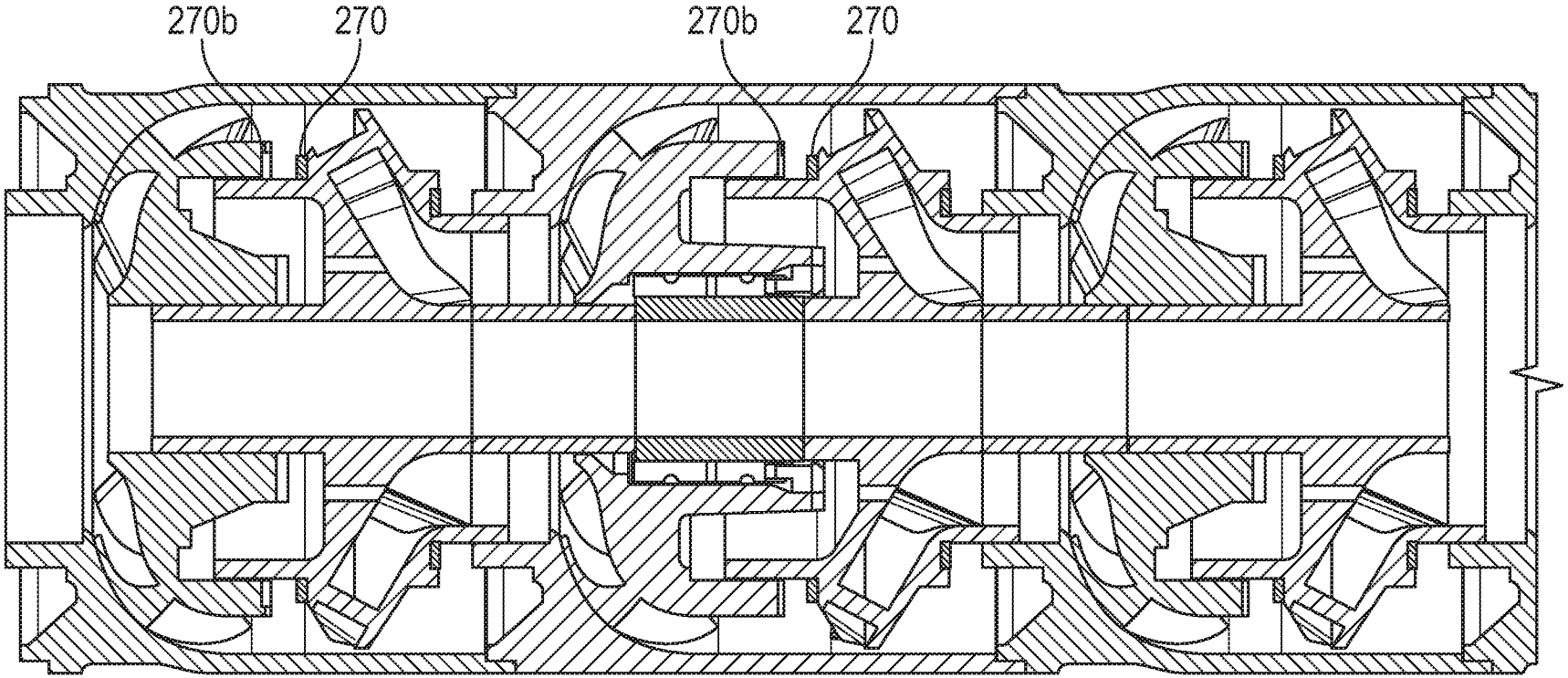
FIG. 8 shows a cross-section of a portion of an example embodiment of a pump section of an ESP including the impeller of FIG. 4, the bearing housing of FIG. 7A, and the diffuser of FIG. 7B.

In some configurations, an upthrust washer 270*b* is disposed on, adjacent, or proximate the leading edge shoulder 222 of the diffuser 220 and/or bearing housing 260, for example as shown in FIGS. 7A-7B. The upthrust washer 270*b* can be made of or include phenolic material, tungsten carbide, silicon carbide, and/or any other suitable material (s), for example, any wear resistant material and/or coating. In the embodiments of FIGS. 7A-8, the upthrust washer 270*b* is disposed in a recessed portion of the ring 226 (e.g., recessed into the ring 226 in a downstream direction from the leading edge shoulder 222). As shown, the upthrust washer 270*b* can have a radial width less than a radial thickness of the ring 226 such that the upthrust washer 270*b* does not cover the entire radial width of the ring 226, and the upthrust washer 270*b* sits flush with the leading edge shoulder 22. In some configurations, the pump 112 includes both an upthrust washer 270 at, adjacent, or proximate the impeller tip and an upthrust washer 270*b* on, adjacent, or proximate the leading edge shoulder 222 of the diffuser 220 and/or bearing housing 260, for example as shown in FIG. 8. Any one or more of the upthrust washer 270, upthrust washer 270*b*, impeller (e.g., balance ring tip 212), diffuser 220/bearing housing 260 (e.g., leading edge shoulder 222 and/or hub 214), and upthrust ring 256 can include lubrication grooves 290 as shown. The lubrication grooves 290 can have various shapes or profiles, for example, squared, rounded, semi-rounded, V-shaped, W-shaped, and/or spiraled in a clockwise or counter-clockwise direction.

Figure 9:
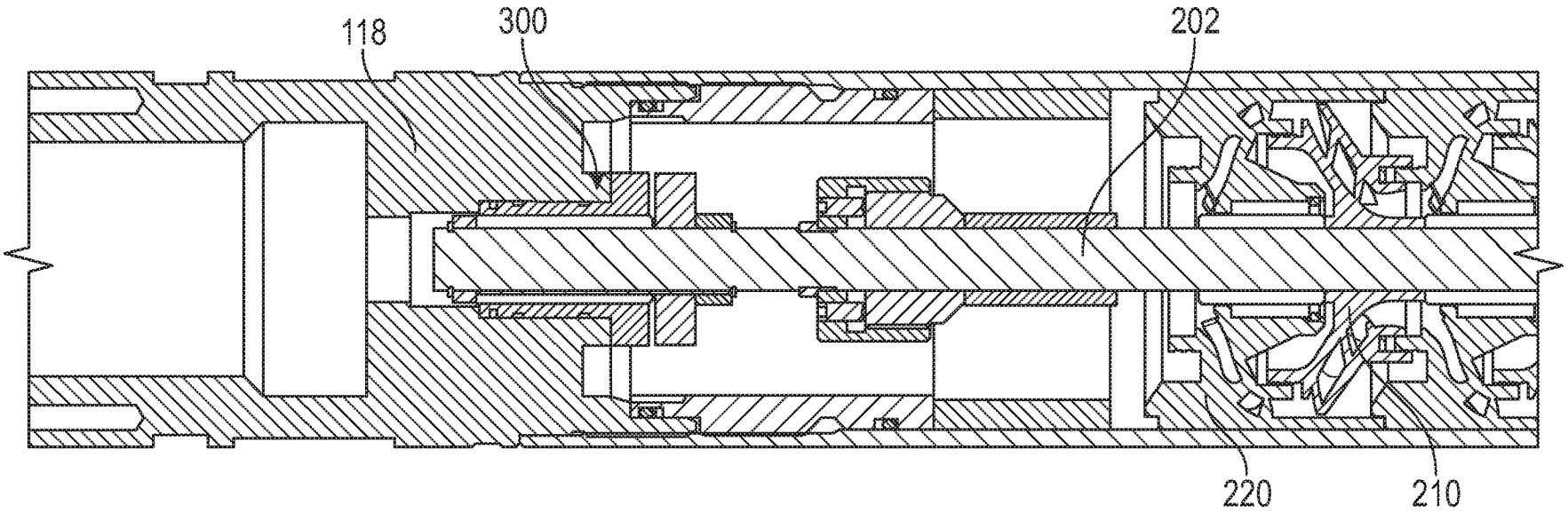
FIG. 9 shows a cross-section of a portion of a pump section of an ESP including an example embodiment of an upthrust bearing.

In some configurations according to the present disclosure, upthrust of the pump 112 can be handled by an upthrust bearing 300 located in the pump 112. The upthrust bearing 300 can be made of or include ceramic. In use, because the impellers 210 are fixed to or locked onto the shaft 202, a sub-assembly of the shaft 202 and stack of impellers 210 move up and/or down as one body. Therefore, upthrust could be handled and/or restricted at a single location with a single upthrust bearing 300. FIG. 9 illustrates a configuration in which the upthrust bearing 300 is located at least partially at or on a top of the pump 112, for example, at least partially at or in a head section 118 of the pump 112. However, the upthrust bearing 300 could be located elsewhere within the pump 112.

The upthrust bearing 300 can include a bearing sleeve 302 disposed about the shaft 202 and a bushing 304 disposed about the bearing sleeve 302 and radially at least partially between the bearing sleeve 302 and the head section 118. One or more o-rings 306 can optionally be disposed about the bushing 304, for example, radially between the bushing 304 and the head section 118, to help secure or mount the bushing 304 in the head section 118. Additionally or alternatively, the bushing 304 can be secured in the head section 118 via an interference fit. An axial retention ring 308 can be disposed at least partially radially between the bushing 304 and the head section 118. In the illustrated configurations, the axial retention ring 308 is at least partially disposed in a recess or groove 314 (shown in FIG. 11B) in an outer surface of the bushing 304. The axial retention ring 308 helps axially locate the bushing 304 and/or helps prevent or inhibit the bushing 304 from moving axially relative to the head 118. A compliance can be introduced between the upthrust bearing 300 (or components thereof) and the head section 118 to prevent or inhibit impact loading onto the bearing system.

The bearing sleeve 302 can be keyed or rotationally coupled to the shaft 202 such that the bearing sleeve 302 rotates with the shaft 202 in use. For example, in the illustrated configuration, the bearing sleeve 302 is keyed to the shaft 202 via an elongated key 310 extending axially along the bearing sleeve 302 and a portion of the shaft 202. In some configurations, a spacer 350 is disposed about the shaft 202 above or downstream of the bearing sleeve 302 and bushing 304. The spacer 350 can be secured to or relative to the shaft 202 via a retaining ring 352 disposed above or downstream of the spacer 350 and at least partially disposed in a groove in the outer surface of the shaft 202. The spacer 350 can help located the bearing sleeve 302 on the shaft 202.

Figure 10:
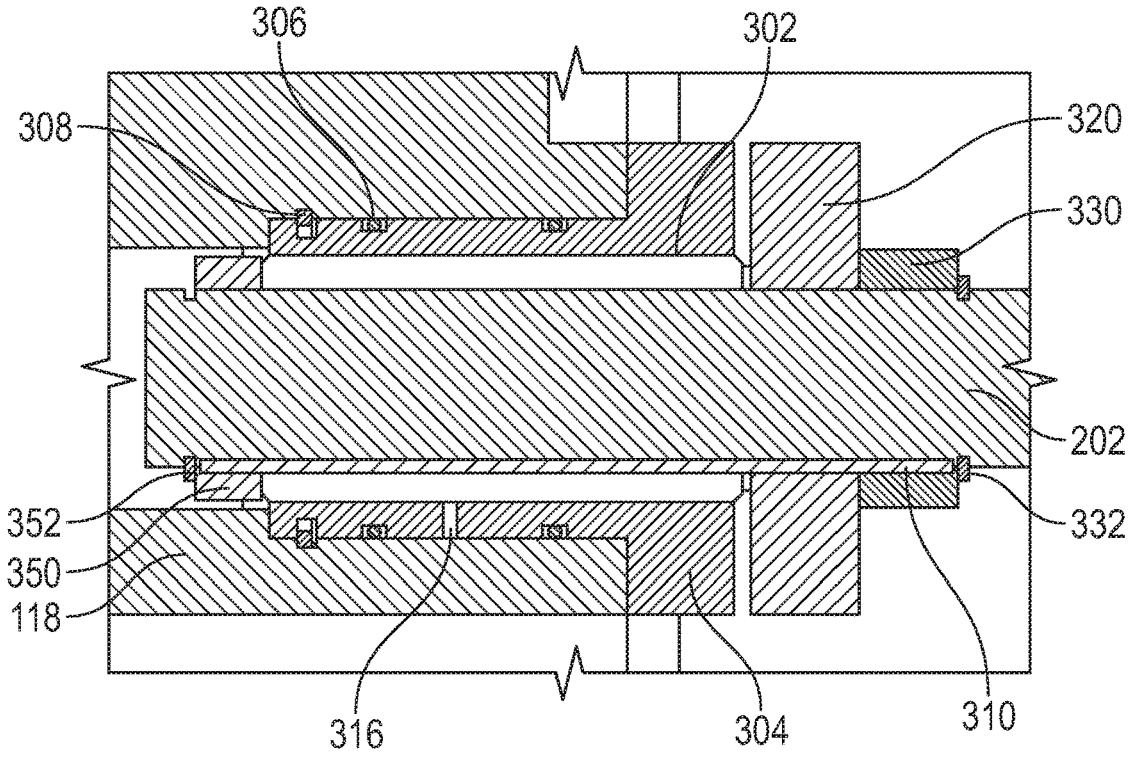
FIG. 10 shows a close-up cross-section of a portion of FIG. 9.
Figure 11A:
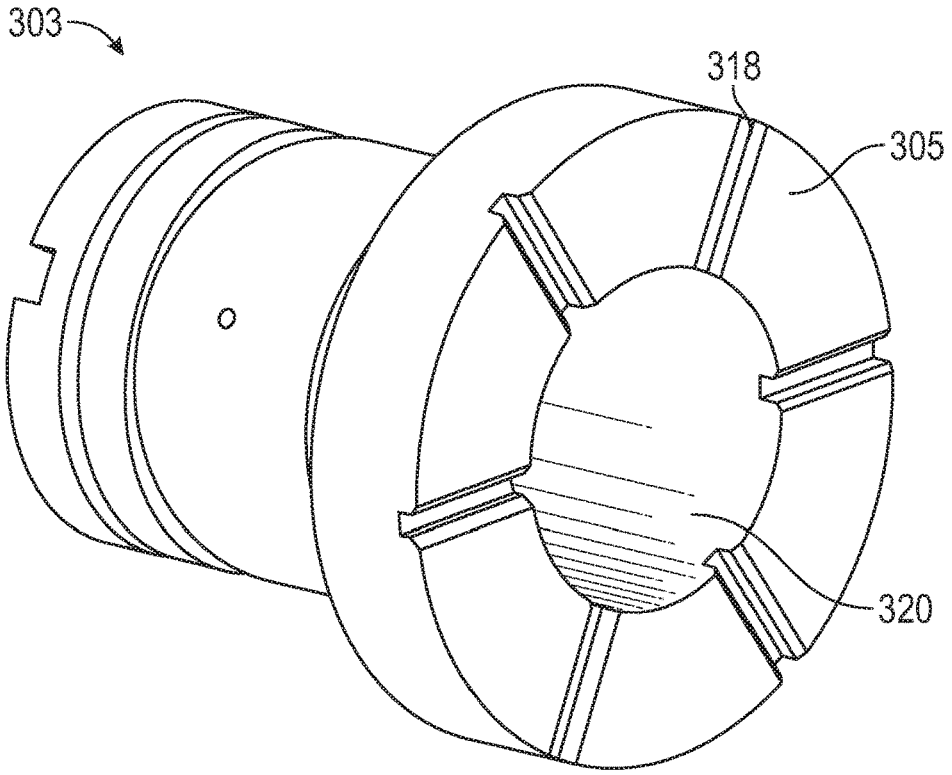
FIGS. 11A-11B show views of the upthrust bearing of FIG. 10.
Figure 11B:
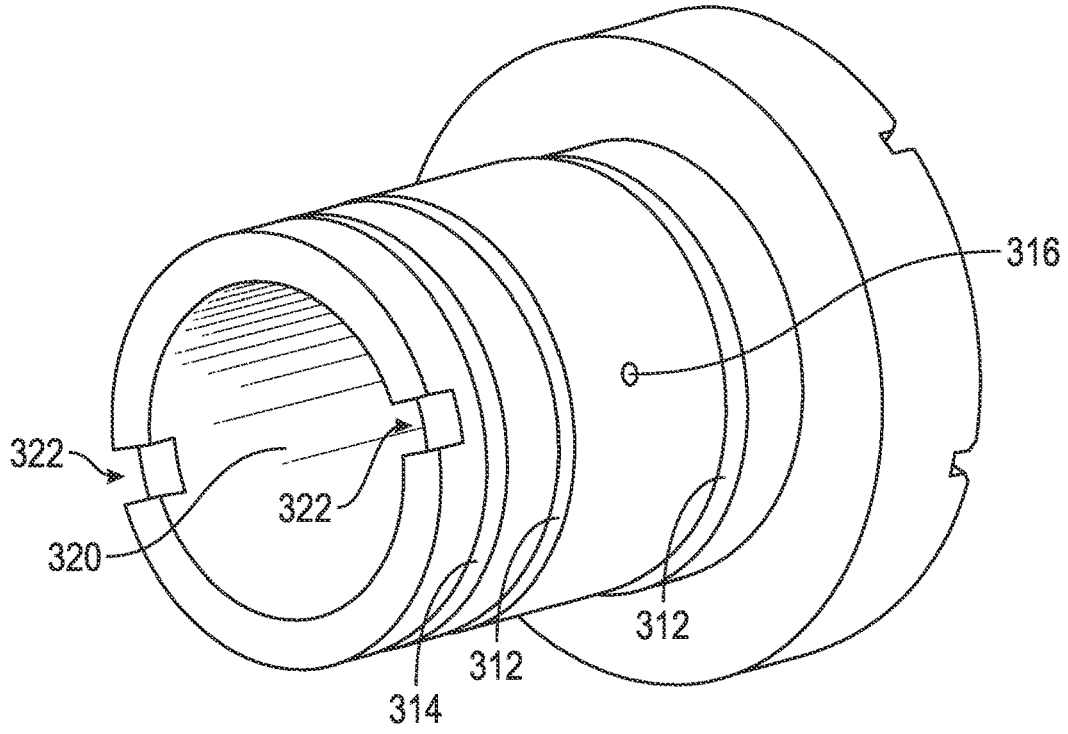

The bushing 304 can have a generally T-shaped longitudinal cross-sectional shape, for example as shown in FIG. 10 and FIGS. 11A-11B. The head section 118 can have an internal profile designed to accommodate the T-shaped bushing 304. As shown in FIGS. 11A-11B, an outer surface of a stem or base portion 303 of the bushing 304 can include one or more circumferential grooves 312 designed to house the o-rings 306. The outer surface of the stem or base portion 303 can include a circumferential groove 314 designed to house the axial retention ring 308. The stem or base portion 303 can include a pin hole 316 extending therethrough to prevent or inhibit trapped pressure. An inner journal bearing surface 320 of the base portion 303 surrounding the bore of the bushing 304 can act as a radial bearing surface. The bushing 304 can be made of or include a hard allow or ceramic material.

A crossbar portion of the bushing 304 forms a thrust pad 305. The thrust pad 304, for example, an upstream end or surface (disposed opposite or away from the base portion 303) of the thrust pad 304, can include one or more grooves 318. In the illustrated configuration, the grooves 318 extend radially outwardly from a central bore or journal bearing surface 320 of the bushing 304 to a radial outer edge of the thrust pad 305. The grooves 318 can allow for the flow of fluid, for example, for lubrication, in use.

Figure 13A:
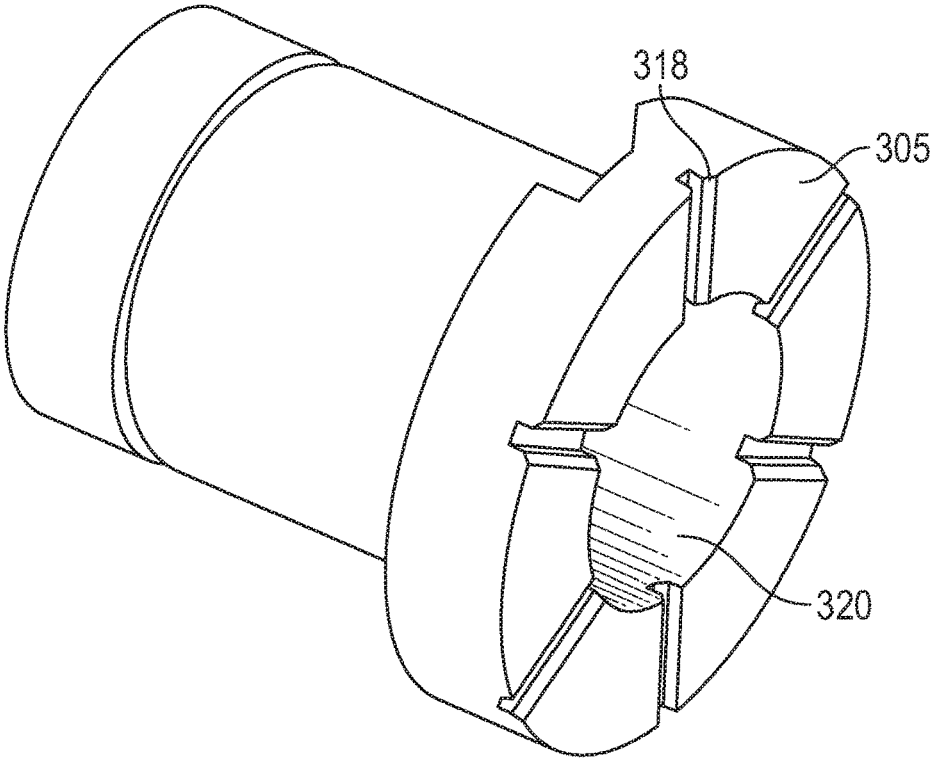
FIGS. 13A-13B show views of the upthrust bearing of FIG. 12.
Figure 13B:
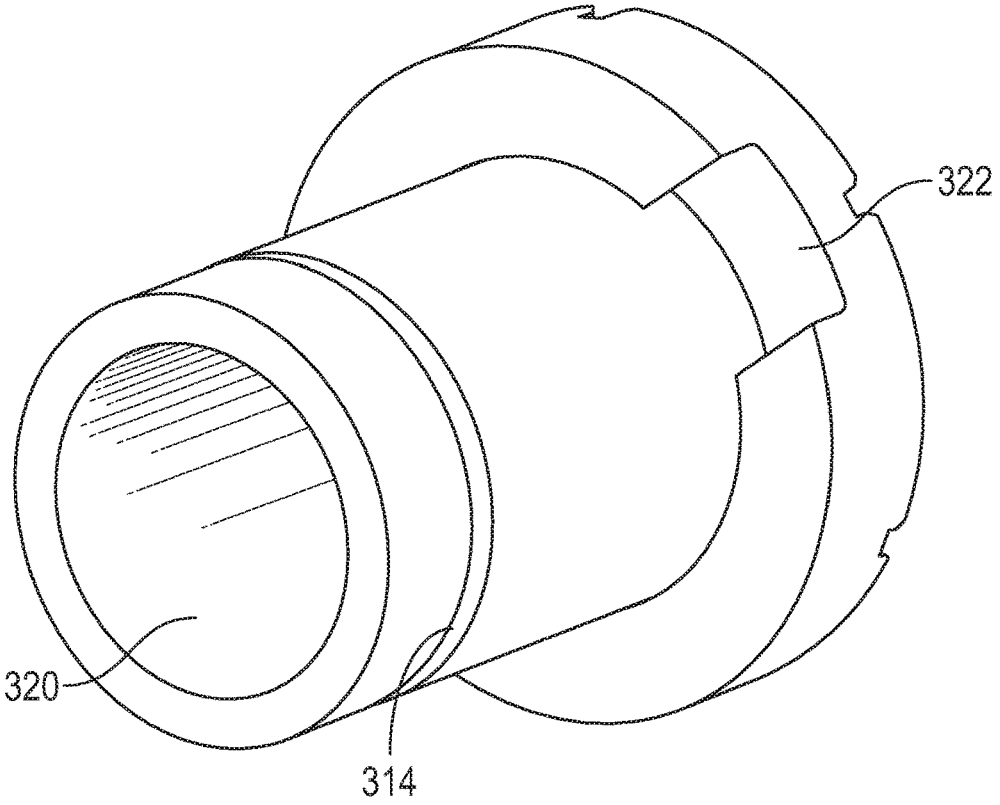
Figure 14A:
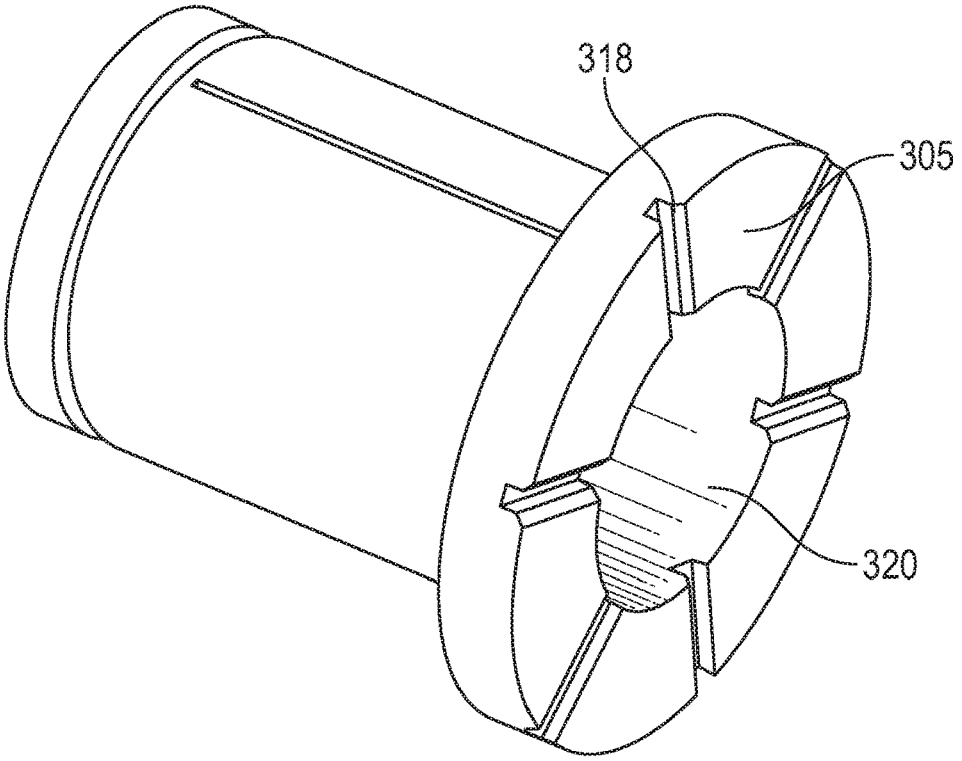
FIGS. 14A-14B show views of another example embodiment of an upthrust bearing.
Figure 14B:
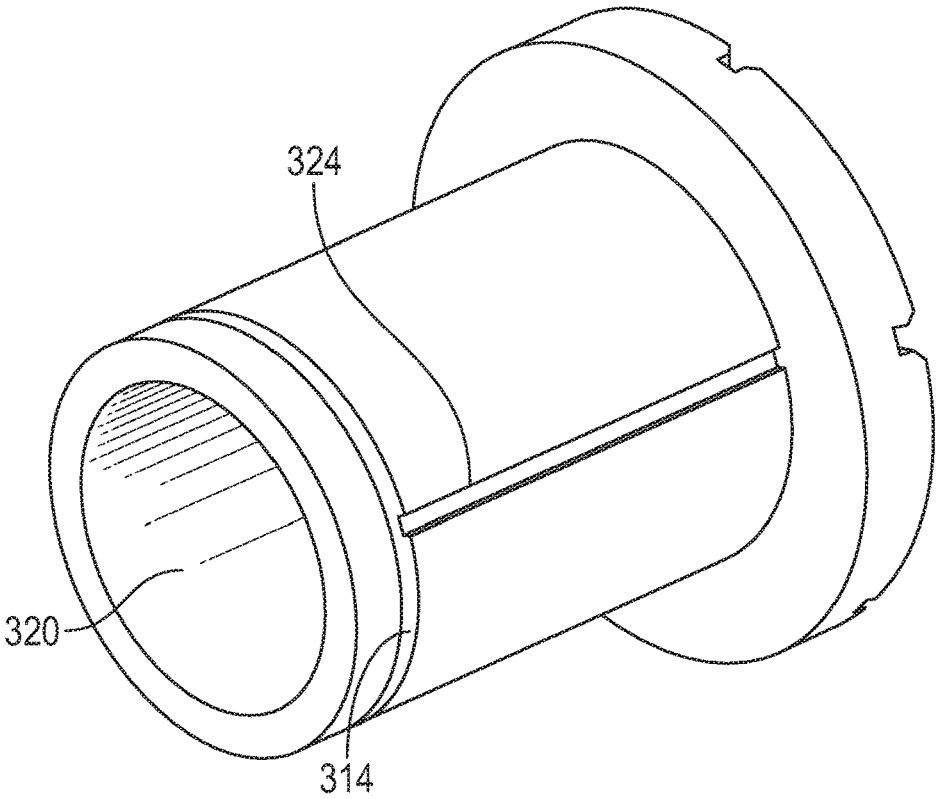

The bushing 304 can include one or more anti-rotation features that act to prevent or inhibit the bushing 304 from rotating in use. The anti-rotation feature(s) can rotationally fix the bushing 304 to, for example, the head section 118. The anti-rotation features can be or include one or more notches 322, for example as shown in FIGS. 11A-11B and 13A-13B. The notches 322 can receive a corresponding feature, such as a protrusion, for example, on the head section 118, to rotationally fix the bushing 304. In the embodiment of FIGS. 11A-11B, the notches 322 disposed at the end, e.g., the top, downstream end, or end opposite the thrust pad 304, of the bushing 304. In the embodiment of FIGS. 13A-13B, the notches 322 are disposed in a surface, e.g., a downstream surface or surface adjacent the base portion 303, of the thrust pad 305. In some configurations, for example as shown in FIGS. 14A-14B, the anti-rotation feature can be or include a keyway 324 extending along the base portion 303. In the illustrated configuration, the keyway 324 is recessed into the outer surface of the base portion 303 and extends axially along at least a portion of the base portion 303. The keyway 324 can receive a corresponding key, such as a protrusion, for example, on the head section 118.

Figure 15:
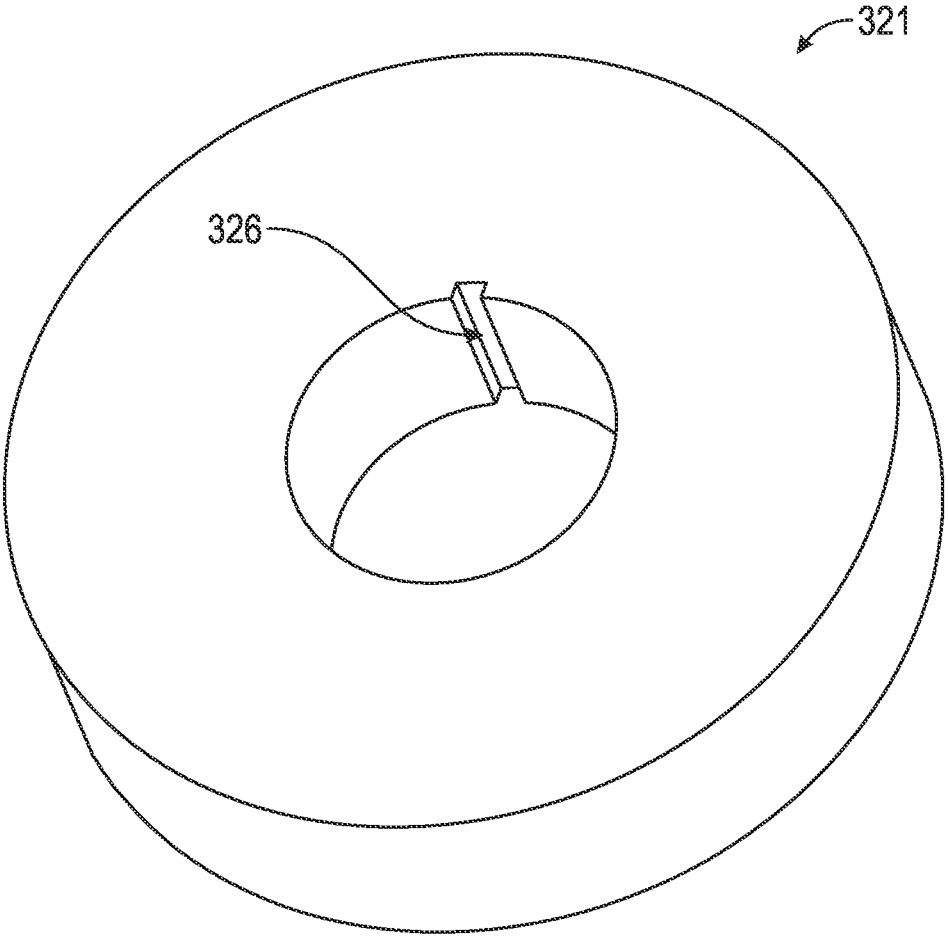
FIG. 15 shows a perspective view of an example embodiment of an upthrust runner.

An upthrust bearing runner 321, also shown in FIG. 15, is disposed about the shaft 202 below or upstream of the bushing 304. The runner 321 can be made of or include one or more hard alloys and/or a ceramic material. The runner 321 can be rotationally fixed to the shaft 202. In the illustrated configuration, an inner surface, or surface surrounding the bore, of the runner 321 includes a notch, keyway, groove, or recess 326 that receives the key 310. In use, when the sub-assembly of the shaft 202 and impellers 210 operate in upthrust conditions, the runner 321 is shifted upward toward the thrust pad 305 and may contact the thrust pad 305. The upstream surface of the thrust pad 305 therefore can accommodate or handle upthrust.

Figure 12:
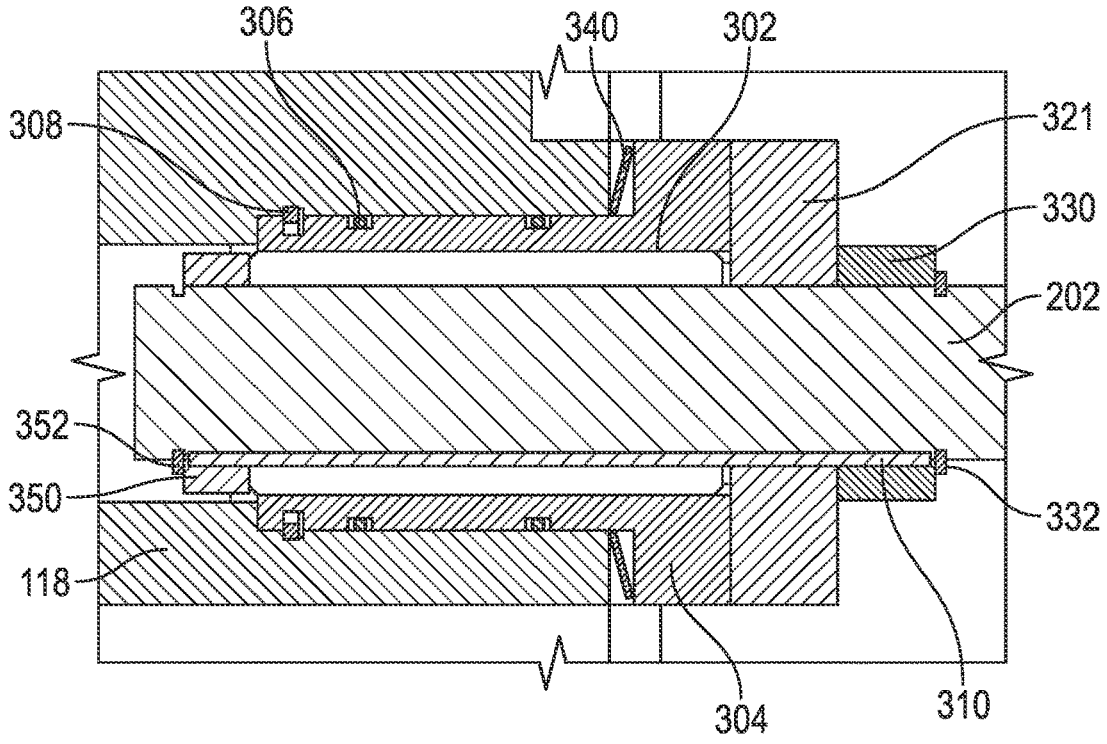
FIG. 12 shows a cross-section of a pump section of an ESP including another example embodiment of an upthrust bearing.

In some configurations, for example as shown in FIG. 12, the thrust pad 305 is preloaded into contact or engagement with the runner 321. In the illustrated configuration, the thrust pad 305 is preloaded via a spring 340 disposed axially between the downstream surface (or surface opposite the thrust surface and adjacent the base portion 303) of the thrust pad 305 and the head section 118.

The runner 321 is axially located along the shaft 202 and/or relative to the bushing 304 to achieve a required or desired setting and upthrust gap. The runner 321 can be appropriately axially located using a spacer 330. The spacer 330 is disposed about the shaft 202 upstream of the runner 321. The runner 321 is therefore disposed axially between the bushing 304 and the spacer 330. The spacer 330 can be secured in place on the shaft 202 with a retaining ring 332. In the illustrated configuration, the retaining ring 332 is disposed below or upstream of the spacer 330 and/or adjacent a bottom or upstream surface of the spacer 330. The retaining ring 332 can be at least partially disposed in a groove formed in an outer surface of the shaft 202.

In some configurations, the pump 112 includes one or more downthrust assemblies, each of which can include a downthrust washer 280. The downthrust washer 280 can be disposed on an impeller 210 downthrust pad or in an impeller 210 groove. In the configurations of FIGS. 2A and 2B, the downthrust washer 280 is disposed in a recess or downthrust groove 216 in a downwardly or upstream facing surface of the impeller 210. The recess or groove 216 can be disposed in a projection extending from a downward facing or bottom surface of the lower plate 215 of the impeller 210. In use, the downthrust washer 280 contacts the adjacent upstream diffuser 220 when the pump 112 is operating in downthrust conditions, for example, at or near the minimum operating range or near the shut in point in the field.

As described herein, in some cases, thrust washers, such as upthrust washer 270 and/or downthrust washer 280, become worn and/or fail during use. Downthrust wear and/or damaged or missing downthrust washers 280 can occur sooner when operating in unfavorable downthrust conditions. If the downthrust washer 280 is damaged or wears off, for example, in a sandy or unconventional well, there could be metal-to-metal downthrust wear (for example, on the thrust pad), which can significantly increase the horsepower of the ESP. In some cases, extreme heat could be generated, which could eventually lead to shaft 202 damage, due to, for example, lack of lubrication (due to vaporization of liquid in the area due to the heat), heat, and/or shaft 202 seizure (for example, due to expansion of metal components).

In some configurations according to the present disclosure, the downthrust washer 280 is thicker than traditional washers. The thicker downthrust washer 280 can be disposed on the impeller 210. The thicker downthrust washer 280 can advantageously share the load among the plurality of stages in a compression pump. In use, when the impeller 210 operates in downthrust conditions, each washer 280 contacts the adjacent upstream diffuser 220. This allows the compression pump to act like a floater pump.

The downthrust washer 280 of the current disclosure can be made of or include an elastic material, phenolic CE, CFE material, and/or another suitable material. The material(s) can be selected such that the stiffness of the downthrust washer 280 is not too low, but can be sufficiently deformed to share the axial thrust load of the pump in use. Whereas traditional downthrust washers typically have thicknesses in the range of about 0.015 in. to about 0.062 in., the thickness of downthrust washers 280 according to the present disclosure can be greater than about 0.10 in, for example, about 0.125 in. Traditionally, such an increase in thickness would have been considered undesirable, as an increase in the downthrust washer thickness in a traditional pump would have increased the pump length and therefore the cost. However, in pumps 112 according to the present disclosure including the thicker downthrust washer 280, the thrust load is advantageously shared among the stages throughout the pump 112. The benefits of the load distribution and sharing can outweigh potential increases in cost.

Figure 16A:
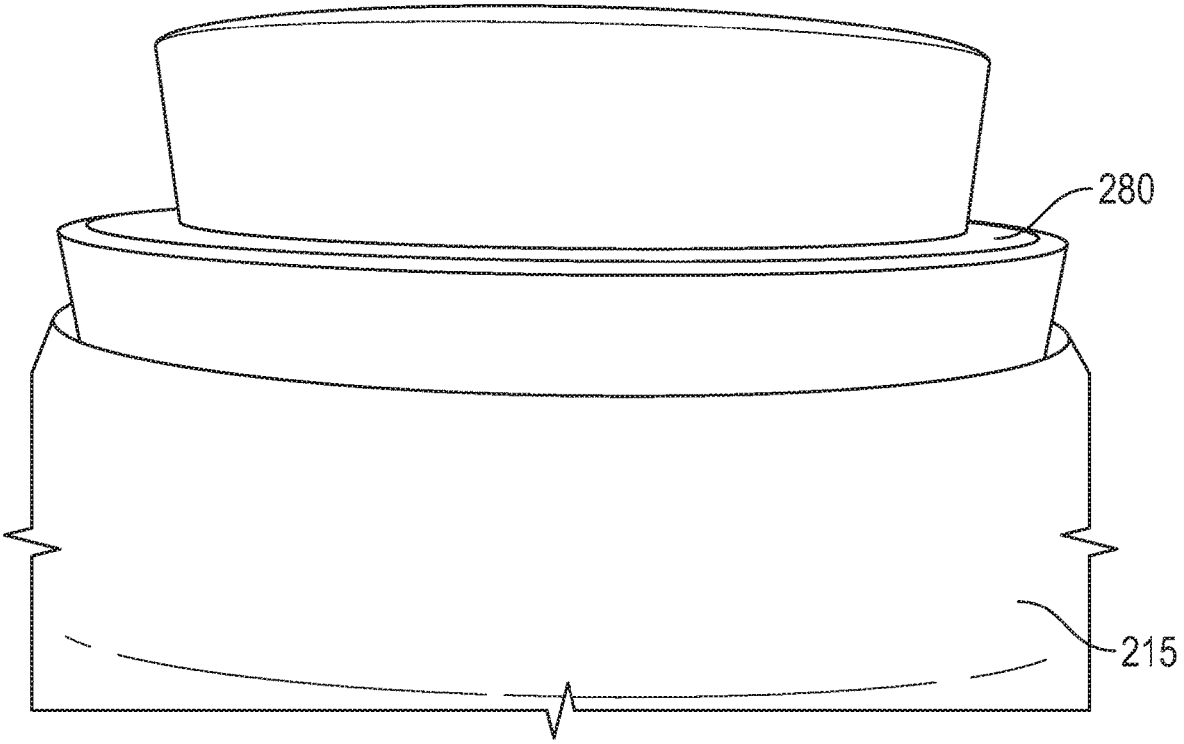
FIG. 16A shows an impeller including a traditional downthrust washer.
Figure 16B:
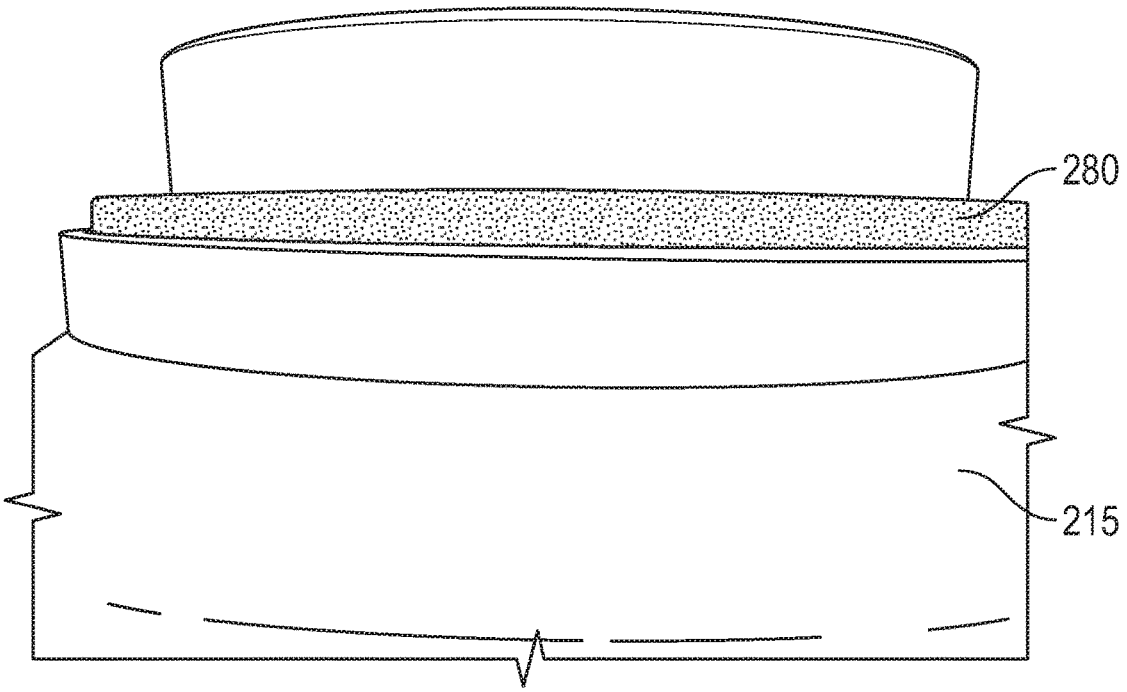
FIG. 16B shows an impeller including an example embodiment of a thicker downthrust washer according to the present disclosure.
Figure 17:
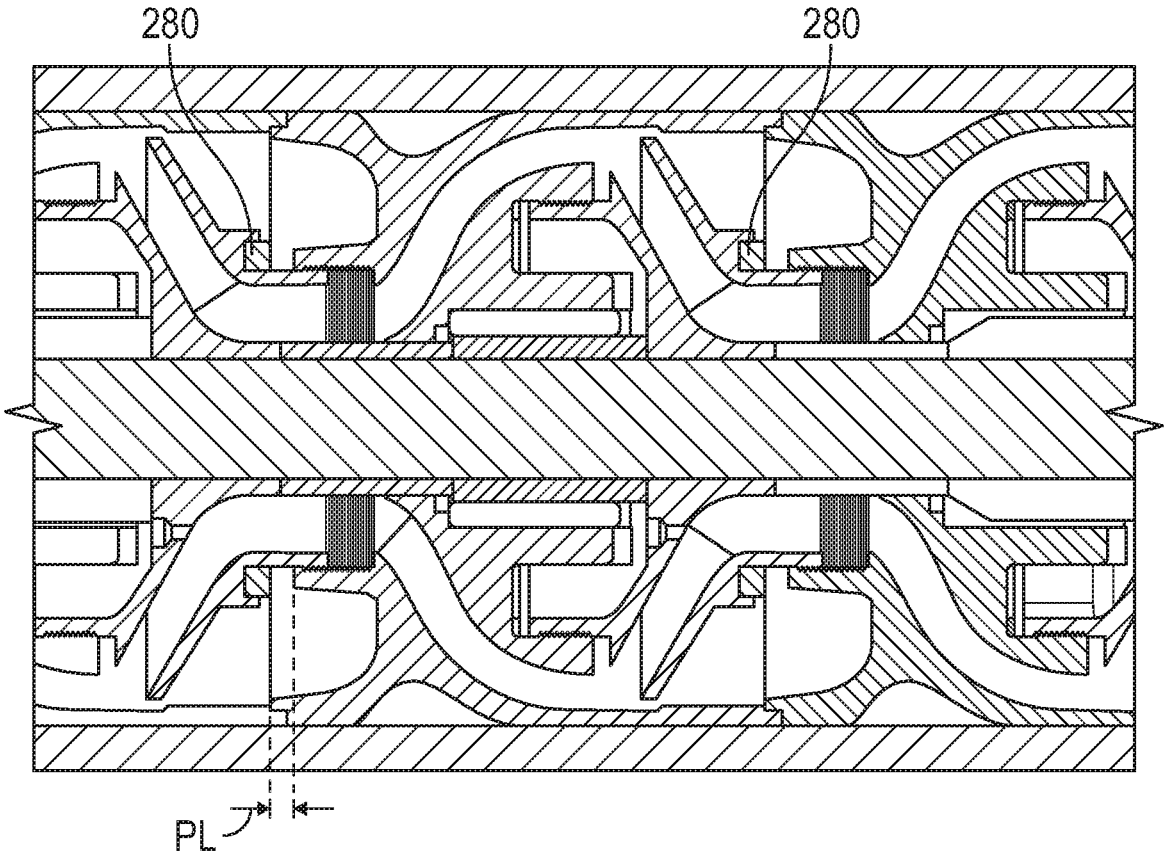
FIG. 17 shows a cross-section of an example embodiment of a pump section of an ESP including the thicker downthrust washer of FIG. 16B.
Figure 18:
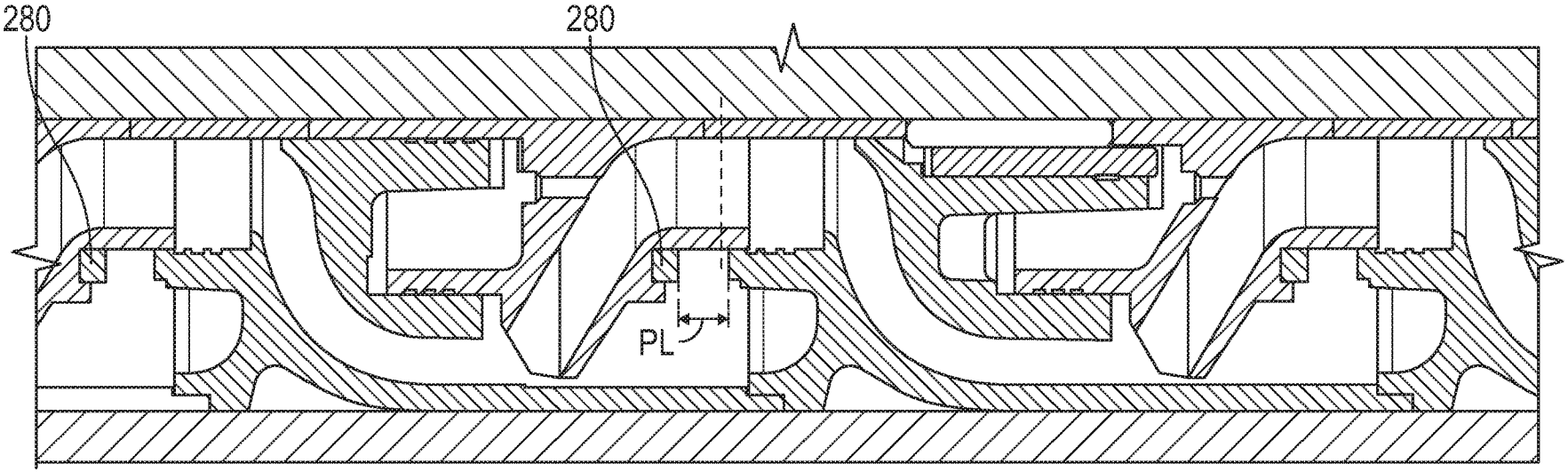
FIG. 18 shows a partial cross-section of another example embodiment of a pump section of an ESP including the thicker downthrust washer of FIG. 16B.
Figure 19:
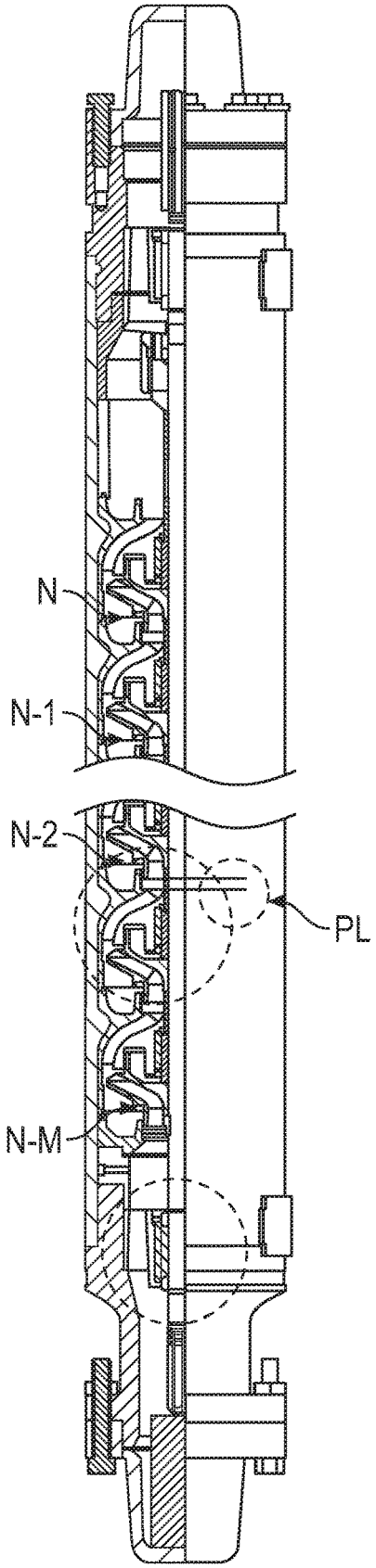
FIG. 19 shows a partial cross-section of a pump section of an ESP including the thicker downthrust washer of FIG. 16B.

FIG. 16A shows a traditional downthrust washer 280 compared to FIG. 16B, which shows a thicker downthrust washer 280 according to the present disclosure. As shown in FIG. 16A, the traditional downthrust washer may be flush with the surface of the impeller 210 defining the groove 216. In contrast, the thicker downthrust washer 280 of the present disclosure may extend past or beyond, e.g., upstream of, that surface or extend out of, e.g., upstream of, the groove 216, as shown in FIG. 16B. FIGS. 17-19 show the thicker downthrust washer 280 disposed in example configurations of the pump 112.

Figure 20A:
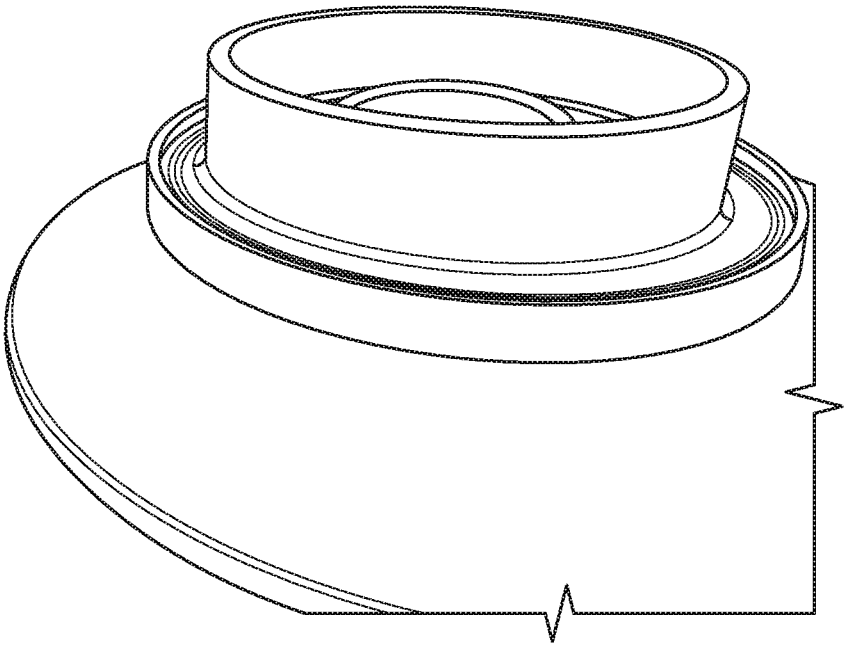
FIG. 20A shows an impeller that included the traditional downthrust washer of FIG. 16A after a mini sand loop test.
Figure 20B:
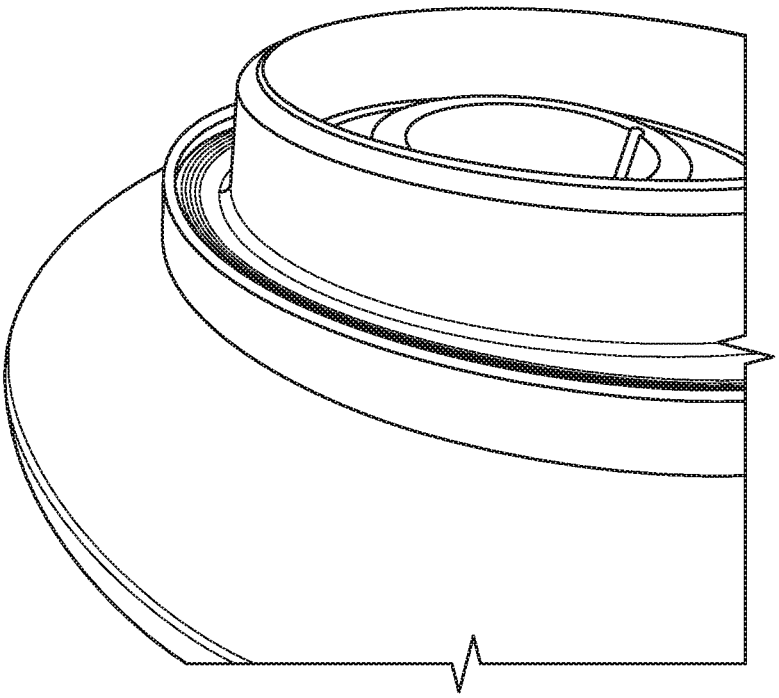
FIG. 20B shows an impeller that included the thicker downthrust washer of FIG. 16B after a mini sand loop test.

During field installation and operation, the pump 112 is shimmed to or by a certain amount. In the illustrated configurations, the pump 112 can be shimmed about 0.122 in. In use, when the pump 112 is running at minimum OR, or at any flow rate that results in a downthrust condition, deflection of the shaft 202 causes the pre-lift gap PL (shown in FIGS. 17-19) to close and the downthrust washer 280 to contact the adjacent upstream diffuser 220. The smallest pre-lift gap PL in the pump 112 is unknown. For example, the smallest pre-lift gap PL could be at the top stage N or any subsequent stage from N-1 to the bottom stage N-M. As an example, if the top stage N has the smallest pre-lift gap PL, the downthrust washer 280 of the top stage N will start wearing away first in use. As washer 280 N wears down, the N-1 pre-lift gap closes and the washer 280 of stage N-1 contacts the adjacent diffuser 220, followed by stage and washer N-2, and so on. At the beginning, the top washer 280 N is subjected to the maximum axial thrust load of the entire pump 112. When the N-1, N-2, and subsequent washers 280 come into contact with their adjacent diffusers 220, the axial load becomes shared among the washers 280. The pump 112 can therefore then act like a floater pump, and the wear rate of individual washers 280 slows significantly. FIGS. 20A and 20B show a mini sand loop wear rate comparison between a standard 0.062" washer and a thicker downthrust washer 280, respectively. As shown, the thicker washer 280 delays metal-to-metal wear due to the increased washer 280 thickness and its cushioning effect.

Language of degree used herein, such as the terms "approximately," "about," "generally," and "substantially"

as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. An electric submersible pump (ESP) comprising a plurality of stages, at least one stage comprising:

a rotating impeller rotationally fixed to a shaft of the ESP, the impeller comprising a balance ring;

a stationary diffuser rotationally fixed to a housing of the ESP;

an upthrust washer disposed axially between a portion of the impeller and a portion of the diffuser, the upthrust washer disposed radially outside of the balance ring; and a bearing assembly disposed radially between the shaft and the diffuser, wherein an axial gap between the portion of the impeller and the portion of the diffuser is smaller than an axial gap between the bearing assembly and an upwardly facing surface of the impeller disposed radially between a central hub of the impeller and the balance ring of the impeller.

2. The ESP of claim 1, further comprising a second upthrust washer disposed adjacent a leading edge shoulder of the diffuser.

3. The ESP of claim 2, wherein the second upthrust washer comprises one or more lubrication grooves.

4. The ESP of claim 1, wherein the balance ring of the impeller comprises one or more lubrication grooves.

5. The ESP of claim 1, wherein the diffuser comprises one or more lubrication grooves.

6. The ESP of claim 5, wherein a central hub of the diffuser comprises one or more lubrication grooves in a leading or upstream edge of the central hub.

7. The ESP of claim 5, wherein a ring surrounding a central hub of the diffuser comprises one or more lubrication grooves in a leading edge shoulder of the ring.

8. The ESP of claim 1, wherein the upthrust washer comprises phenolic material, tungsten carbide, or silicon carbide.

9. The ESP of claim 1, wherein an axial gap between the portion of the impeller and the portion of the diffuser is smaller than an axial gap between a downstream edge of the balance ring of the impeller and the diffuser.

10. The ESP of claim 1, wherein an axial gap between the portion of the impeller and the portion of the diffuser is smaller than an axial gap between the diffuser and an upwardly facing surface of the impeller disposed radially between a central hub of the impeller and the balance ring of the impeller.

11. An electric submersible pump (ESP) comprising:

a plurality of centrifugal stages, each stage comprising a rotating impeller coupled to a rotating shaft and a stationary diffuser disposed about the rotating impeller; and an upthrust bearing assembly disposed radially between the shaft and the diffuser, wherein an axial gap between a portion of the impeller and a portion of the diffuser is smaller than an axial gap between the upthrust bearing assembly and an upwardly facing surface of the impeller disposed radially between a central hub of the impeller and the balance ring of the impeller and comprising:

a bearing sleeve disposed about the shaft and rotationally keyed to the shaft;

a stationary bushing disposed about the bearing sleeve, the bushing having a generally T-shaped longitudinal cross-section shape and a bore extending longitudinally therethrough, the bushing having a base portion and a thrust pad at an upstream end of the base portion; and an upthrust bearing runner disposed about the shaft upstream of the bushing, the upthrust bearing runner configured to move toward an upthrust surface of the thrust pad of the bushing when the ESP operates in an upthrust condition.

12. The ESP of claim 11, wherein the upthrust bearing assembly is disposed proximate a top or downstream end of the plurality of centrifugal stages.

13. The ESP of claim 11, wherein the upthrust bearing assembly is disposed in a pump head section.

14. The ESP of claim 11, wherein the upthrust surface comprises one or more grooves configured to allow fluid flow.

15. The ESP of claim 11, the bushing comprising an anti-rotation feature configured to rotationally fix the bushing.

16. The ESP of claim 15, wherein the anti-rotation feature comprises notches in a downstream end of the base portion and/or a downstream surface of the thrust pad.

17. The ESP of claim 15, wherein the anti-rotation feature comprises a groove in an outer surface of the base portion extending axially along at least a portion of a length of the base portion.

* * * * *